US007762747B2

(12) United States Patent
Taniuchi et al.

(10) Patent No.: US 7,762,747 B2
(45) Date of Patent: Jul. 27, 2010

(54) CERMET INSERT AND CUTTING TOOL

(75) Inventors: Toshiyuki Taniuchi, Toride (JP); Masafumi Fukumura, Toride (JP); Kei Takahashi, Tsukuba (JP); Tomoaki Shindo, Nagoya (JP); Atsushi Komura, Kiyosu (JP); Hiroaki Takashima, Komaki (JP)

(73) Assignees: Mitsubishi Materials Corporation, Tokyo (JP); NGK Spark Plug Co., Ltd., Nagoya-shi (JP)

( * ) Notice: Subject to any disclaimer, the term of this patent is extended or adjusted under 35 U.S.C. 154(b) by 427 days.

(21) Appl. No.: 11/916,329

(22) PCT Filed: Jun. 13, 2006

(86) PCT No.: PCT/JP2006/311873

§ 371 (c)(1),
(2), (4) Date: Dec. 3, 2007

(87) PCT Pub. No.: WO2006/134944

PCT Pub. Date: Dec. 21, 2006

(65) Prior Publication Data

US 2010/0014930 A1 Jan. 21, 2010

(30) Foreign Application Priority Data

| | | |
|---|---|---|
| Jun. 14, 2005 | (JP) | 2005-173463 |
| Sep. 7, 2005 | (JP) | 2005-259169 |
| Sep. 7, 2005 | (JP) | 2005-259170 |
| Sep. 7, 2005 | (JP) | 2005-259171 |
| Oct. 18, 2005 | (JP) | 2005-303095 |
| Oct. 18, 2005 | (JP) | 2005-303096 |

(51) Int. Cl.
*B23B 27/14* (2006.01)
*C04B 35/58* (2006.01)

(52) U.S. Cl. ..... 407/119; 501/96.1; 428/697

(58) Field of Classification Search ..... 407/119; 501/96.1; 75/236, 239, 240; 428/299.1, 428/305.5, 210, 697, 698
See application file for complete search history.

(56) References Cited

U.S. PATENT DOCUMENTS

| | | | | | |
|---|---|---|---|---|---|
| 5,569,000 | A | * | 10/1996 | Littecke et al. | 407/114 |
| 5,766,742 | A | * | 6/1998 | Nakamura et al. | 428/210 |
| 5,976,707 | A | * | 11/1999 | Grab | 428/547 |

FOREIGN PATENT DOCUMENTS

| | | | |
|---|---|---|---|
| JP | 62-170452 | A | 7/1987 |
| JP | 10-110234 | A | 4/1998 |
| JP | 2002-263940 | | 9/2002 |
| JP | 2004-292842 | A | 10/2004 |

* cited by examiner

*Primary Examiner*—Will Fridie, Jr.
(74) *Attorney, Agent, or Firm*—Leason Ellis LLP.

(57) ABSTRACT

One aspect of this titanium carbonitride-based cermet insert has a microstructure including 75 to 90 area % of a hard phase and the balance as a binding phase, wherein the hard phase includes a first hard phase in which a core-having structure includes a TiCN phase and a peripheral portion includes a (Ti,W,Ta/Nb)CN phase, a second hard phase including a (Ti, W,Ta/Nb)CN phase, and a third hard phase including a TiCN phase, and the binding phase contains 18 to 33% of Co, 20 to 35% of Ni, 5% or less of Ti and Ta and/or Nb, and 40 to 60 mass % of W. In another aspect of this cermet insert, a total of an amount of Ti converted as carbonitride, an amount of Ta and/or Nb converted as carbide, and an amount of W converted as carbide is 70 to 95 mass %, an amount of W converted as carbide is 20 to 35 mass %, and Co and Ni are 5 to 30 mass %, this cermet insert has a microstructure including a hard phase containing (Ti,W,Ta/Nb)CN and a binding phase containing, as main components thereof, W and Co and/or Ni, and 40 to 65 mass % of the W is contained in the hard phase. This cutting tool includes a holder and the cermet insert described above held and fixed by the holder.

12 Claims, 6 Drawing Sheets

CERMET INSERT AND CUTTING TOOL

CROSS REFERENCE TO PRIOR APPLICATION

This is a U.S. National Phase Application under 35 U.S.C. §371 of International Patent Application No. PCT/JP2006/311873 filed Jun. 13, 2006, and claims the benefit of Japanese Patent Application Nos. 2005-173463, filed Jun. 14, 2005, 2005-259169 filed Sep. 7, 2005, 2005-259170 filed Sep. 7, 2005, 2005-259171 filed Sep. 7, 2005, 2005-303095 filed Oct. 18, 2005 and 2005-303096 filed Oct. 18, 2005, all of them are incorporated by reference herein. The International Application was published in Japanese on Dec. 21, 2006 as WO 2006/134944 Al under PCT Article 21(2).

TECHNICAL FIELD

The present invention relates to a cermet insert and cutting tool. More particularly, the present invention relates to a titanium carbonitride-based cermet (hereinafter referred to as TiCN-based cermet) insert, in which the binding phase of the TiCN-based cermet has superior high-temperature hardness, and as a result, demonstrates superior wear resistance and breakage resistance during high-speed cutting accompanying the generation of high levels of heat, and a cutting tool provided with this cermet insert.

BACKGROUND ART

As a type of cutting tool used in, for example, turning, inserts including TiCN-based cermet (hereinafter to be simply referred to as cutting inserts) are known in the prior art.

Known examples of the aforementioned cutting inserts have the compositions shown below.

(a) TiCN-based cermet in the form of a sintered body of a compact having a blended composition including in percent by mass (hereinafter "%" refers to "mass %) of:

tungsten carbide (hereinafter referred to as WC): 20 to 30%;

one kind or two kinds of tantalum carbide (hereinafter referred to as TaC) and niobium carbide (hereinafter referred to as NbC) (hereinafter referred to as TaC/NbC): 5 to 10%;

Co: 5 to 10%;

Ni: 5 to 10%; and titanium carbonitride (hereinafter referred to as TiCN): 50 to 60%.

(b) The aforementioned TiCN-based cermet has a microstructure including hard phase: 75 to 90 area %, and binding phase: balance. Here, the surface area ratio is the value measured by observing the microstructure with a scanning electron microscope.

The aforementioned hard phase contains the following (1) to (3) as indicated in the schematic drawing of FIG. 2 showing the results of observing microstructure with a scanning electron microscope (magnification: 10,000-fold).

(1) First hard phase having a core-having structure in which a core portion includes a TiCN phase and a peripheral portion includes a complex carbonitride of Ti, W and one or both of Ta and Nb (hereinafter indicated as (Ti,W,Ta/Nb)CN);

(2) Second hard phase having a core-having structure in which both a core portion and a peripheral portion include (Ti,W,Ta/Nb)CN phases; and (3) Third hard phase having a single phase structure including a TiCN phase.

The aforementioned binding phase includes a Co—Ni alloy having a composition containing, as the ratio in the binding phase and by mass %, W: 1 to 10%, Ni: 35 to 60%, Ti and one kind or two kinds of Ta and Nb (to be indicated as Ta/Nb), the total amount thereof being 5% or less, and Co as the balance.

In addition, the following indicates known examples of cutting inserts containing one kind or two or more kinds of zirconium carbide (hereinafter referred to as ZrC), vanadium carbide (hereinafter referred to as VC) and molybdenum carbide (hereinafter referred to as $Mo_2C$) (hereinafter referred to as ZrC/VC/$Mo_2C$)

(a) TiCN-based cermet in the form of a sintered body of a compact having a blended composition including: in percent by mass (hereinafter "%" refers to "mass %")

WC: 20 to 30%;

TaC/NbC: 5 to 10%;

ZrC/VC/$Mo_2C$: 1 to 5%;

Co: 5 to 10%;

Ni: 5 to 10%; and

TiCN: 50 to 60%.

(b) The aforementioned TiCN-based cermet has a microstructure including hard phase: 75 to 93 area %, and binding phase: balance. Here, the surface area ratio is the value measured by observing the microstructure with a scanning electron microscope.

The aforementioned hard phase contains the following (1) to (3) as indicated in the schematic drawing of FIG. 3 showing the results of observing microstructure with a scanning electron microscope (magnification: 10,000-fold).

(1) First hard phase having a core-having structure in which a core portion includes a TiCN phase and a peripheral portion includes a complex carbonitride of Ti, W, one kind or two kinds of Ta and Nb, and one kind or two or more kinds of Zr, V and Mo (hereinafter indicated as (Ti,W,Ta/Nb,Zr/V/Mo)CN);

(2) Second hard phase having a core-having structure in which both a core portion and a peripheral portion include (Ti,W,Ta/Nb,Zr/V/Mo)CN phases; and (3) Third hard phase having a single phase structure including a TiCN phase.

The aforementioned binding phase includes a Co—Ni alloy having a composition containing: as the ratio in the binding phase and by mass %, W: 1 to 10%;

Ni: 35 to 60%;

Ti, one kind or two kinds of Ta and Nb (to be indicated as Ta/Nb), and one kind or two or more kinds of Zr, V and Mo (to be indicated as Zr/V/Mo), the total amount thereof being 5% or less; and Co as the balance.

Moreover, a cutting insert as described above is commonly known to be produced by sintering a compact having the aforementioned blended composition under conditions consisting of the steps of the following sintering conditions (i) to (iii), and is used for continuous cutting and intermittent cutting of various types of steels and cast irons.

(i) The temperature is raised from room temperature to 1400 to 1450° C. in a vacuum atmosphere of 10 Pa or less at the rate of 1 to 3° C./min.

(ii) The temperature is raised from 1400 to 1450° C. to a sintering temperature of 1480 to 1560° C. at the rate of 1 to 3° C./min and then holding for 0.5 to 2 hours at the aforementioned sintering temperature. This raising of the temperature and holding at the predetermined temperature are carried out in a nitrogen atmosphere of 50 to 4000 kPa.

(iii) The furnace is cooled from the aforementioned sintering temperature in a vacuum atmosphere of 10 Pa or less.

The performance of cutting apparatuses has increased dramatically in recent years, while demands being placed on cutting with respect to conservation of power, conservation of energy and reduction of costs have become increasingly severe. Accompanying these demands, cutting speeds are tending to increase. However, in the case of cutting steel or cast iron and the like at high cutting speeds of 300 m/min or more using a conventional cutting insert as described above, wear of the binding phase composed of Co—Ni-based alloy of TiCN-based cermet that composes these cutting inserts in particular is accelerated considerably. This causes the current comparatively short service life of these cutting inserts.

In addition, cermet inserts having a microstructure composed of hard phases (hard particles) and binding phase present between the hard phases are used to cut steel and the like, and various technologies have been proposed for improving the performance of these cermet inserts.

For example, Patent Document 2 proposes a TiCN-based cermet composed of an ordinary core-having structure, and more specifically, a core-having structure composed of a plurality of phases consisting of a phase in which a core portion is rich in a group 4*a* element such as Ti and a peripheral portion is rich in group 5*a* and group 6*a* elements such as W and Ta (black phase), and a phase in which a core portion is rich in group 5*a* and group 6*a* elements such as W and Ta (white phase), wherein strength of cermet alloy is improved by dispersing the black phase and the white phase at the optimum ratio.

However, in the technology proposed by the aforementioned Patent Document 2, although strength of cermet alloy is improved to a certain degree according to the composition of the black phase and white phase as described above, it has the problem of adequate considerations not necessarily being given to wear resistance and breakage resistance.

(Patent Document 1) Japanese Unexamined Patent Application, First Publication No. H10-110234

(Patent Document 2) Japanese Unexamined Patent Application, First Publication No. S62-170452

DISCLOSURE OF THE INVENTION

Problems to be Solved by the Invention

In consideration of the aforementioned problems, a first object of the present invention, from the viewpoint of the aforementioned Patent Document 1, is to provide a titanium carbonitride-based cermet insert having superior wear resistance during high-speed cutting.

In addition, in order to solve the problems of the aforementioned Patent Document 2, a second object of the present invention is to provide a cermet insert and a cutting tool capable of maintaining high wear resistance while realizing high breakage resistance.

Means for Solving the Problems

The inventors of the present invention, from the viewpoint of the aforementioned Patent Document 1, conducted research focusing particularly on the binding phase including Co—Ni-based alloy of the TiCN-based cermet that makes up the conventional cutting insert described in Patent Document 1 for the purpose of improving the wear resistance of this cutting insert during high-speed cutting. As a result, the research results indicated in (A) to (C) below were obtained.

(A) A W component solid-soluted in the Co—Ni-based alloy that forms the binding phase during sintering precipitates into solid solution in a peripheral portion of the hard phase, while a portion thereof further goes into solid solution in a core portion. However, in the conventional cutting insert produced under the sintering conditions described above, the ratio of W component contained in the binding phase that precipitates as a solid solution into the peripheral portion of the hard phase is relatively extremely high. Thus, the ratio of W component remaining in the binding phase is low, and the ratio of the W component in the binding phase is 1 to 10%.

(B) During the course of heating in a vacuum atmosphere to 1400 to 1450° C. as described in (i) above for the aforementioned conventional sintering conditions, if alternately changing atmosphere treatment is carried out by repeatedly alternating between holding in an Ar atmosphere for a short period of time and holding in a vacuum atmosphere for a short period of time at the point the temperature has risen to 1200 to 1350° C., precipitation as solid solution of the W component from the binding phase to the peripheral portion of the hard phase during sintering is inhibited considerably. As a result, the W component is contained in the binding phase at an extremely high ratio in the binding phase of 40 to 60%.

Alternately changing atmosphere treatment is preferably carried out by alternately repeating holding for a short period of time in an Ar atmosphere by holding for 1 to 5 minutes in an Ar atmosphere of 10 to 60 kPa and holding for a short period of time in a vacuum atmosphere by holding for 5 to 20 minutes in a vacuum atmosphere of 10 Pa or less two times or more each, and more preferably 3 to 5 times each.

(C) If the W component is contained in the binding phase at an extremely high ratio in the binding phase of 40 to 60%, the high-temperature hardness of the binding phase is further improved. Thus, a cutting insert in which the binding phase of TiCN-based cermet contains W at a high ratio as described above demonstrates superior wear resistance during high-speed cutting accompanying the generation of high levels of heat.

The titanium carbonitride-based cermet insert of the present invention was invented based on the research results described above.

A first aspect of the titanium carbonitride-based cermet insert of the present invention contains a titanium carbonitride-based cermet having a microstructure including 75 to 90 area % of a hard phase and the balance as a binding phase.

The hard phase includes the first to the third hard phases indicated below.

(1) a first hard phase having a core-having structure in which a core portion includes a titanium carbonitride phase, and a peripheral portion includes a complex carbonitride phase having Ti, W, and one kind or two kinds of Ta and Nb (hereinafter referred to as (Ti,W,Ta/Nb)CN).

(2) A second hard phase having a core-having structure in which both a core portion and a peripheral portion include (Ti,W,Ta/Nb)CN phases.

(3) A third hard phase having a single phase structure including a titanium carbonitride phase.

The binding phase contains a W—Co—Ni-based alloy having a composition including, as a ratio in the binding phase and by mass %, at least:

Co: 18 to 33%;

Ni: 20 to 35%;

Ti, and one kind or two kinds of Ta and Nb, the total amount thereof being 5% or less; and W: 40 to 60%. This first aspect of the titanium carbonitride-based cermet insert of the present invention demonstrates superior wear resistance during high-speed cutting accompanying generation of high levels of heat.

In the first aspect of the titanium carbonitride-based cermet insert of the present invention, the titanium carbonitride-based cermet may be a sintered body of a compact having a blended composition including, by mass %, at least:

tungsten carbide: 20 to 30%;

one kind or two kinds of tantalum carbide and niobium carbide 5 to 10%;

Co: 5 to 10%;

Ni: 5 to 10%; and titanium carbonitride: 50 to 60%.

A second aspect of the titanium carbonitride-based cermet insert of the present invention contains a titanium carbonitride-based cermet having a microstructure including 75 to 93 area % of a hard phase and the balance as a binding phase.

The hard phase includes the first to the third hard phases indicated below.

(1) A first hard phase having a core-having structure in which a core portion includes a titanium carbonitride phase, and a peripheral portion includes a complex carbonitride phase having Ti, W, one kind or two kinds of Ta and Nb, and one kind or two or more kinds of Zr, V and Mo (to be referred to as (Ti,W,Ta/Nb,Zr/V/Mo)CN).

(2) A second hard phase having a core-having structure in which both a core portion and a peripheral portion include (Ti,W,Ta/Nb,Zr/V/Mo)CN phases.

(3) A third hard phase having a single phase structure including a titanium carbonitride phase.

The binding phase contains a W—Co—Ni-based alloy having a composition including, as a ratio in the binding phase and by mass %, at least:

Co: 18 to 33%;

Ni: 20 to 35%;

Ti, one kind or two kinds of Ta and Nb, and one kind or two or more kinds of Zr, V and Mo, the total amount thereof being 5% or less; and W: 40 to 60%. The second aspect of the titanium carbonitride-based cermet insert of the present invention demonstrates superior wear resistance during high-speed cutting accompanying the generation of high levels of heat.

In the second aspect of the titanium carbonitride-based cermet insert of the present invention, the titanium carbonitride-based cermet may be a sintered body of a compact having a blended composition including, by mass %, at least:

tungsten carbide: 20 to 30%;

one kind or two kinds of tantalum carbide and niobium carbide: 5 to 10%;

one kind or two kinds of zirconium carbide, vanadium carbide and molybdenum carbide: 1 to 5%;

Co: 5 to 10%;

Ni: 5 to 10%; and titanium carbonitride: 50 to 60%.

A third aspect of a cermet insert of the present invention contains a titanium carbonitride-based cermet including a sintered body containing Ti, one kind or two kinds of Ta and Nb, and W.

A total of an amount of Ti converted as carbonitride, an amount of the one kind or two kinds of Ta and Nb converted as carbide, and an amount of W converted as carbide is 70 to 95 mass % as a ratio to the entire constitution that makes up the sintered body, an amount of W converted as carbide is 20 to 35 mass % as a ratio to the entire constitution, and an amount of Co and Ni is 5 to 30 mass % as a ratio to the entire constitution.

The cermet insert has a microstructure including: a hard phase containing at least a complex carbonitride including Ti, W, and one kind or two kinds of Ta and Nb (to be referred to as (Ti,W,Ta/Nb)CN); and a binding phase including, as main components thereof, W and one kind or two kinds of Co and Ni.

Among the W contained in the entire constitution, 40 to 65 mass % is contained in the hard phase while the balance is contained in the binding phase.

In the third aspect of the cermet insert of the present invention, the hard phase may further contain titanium carbonitride.

An amount of Ti converted as carbonitride may be 45 to 60 mass % as a ratio to the entire constitution, and an amount of one kind or two kinds of Ta and Nb converted as carbide may be 5 to 10 mass % as a ratio to the entire constitution.

These numerical ranges are exemplary of the preferable contents of Ti, Ta and/or Nb, and if Ti is within this range, wear resistance becomes higher, while if Nb and/or Ta are within this range, thermal shock resistance becomes higher.

The hard phase may include one kind or two kinds of:

(1) a first hard phase having a core-having structure in which a core portion includes titanium carbonitride and a peripheral portion includes a (Ti,W,Ta/Nb)CN phase; and (2) a second hard phase having a core-having structure in which both a core portion and a peripheral portion include (Ti,W,Ta/Nb)CN phases.

The hard phase may further include:

(3) a third hard phase having a single phase structure including a titanium carbonitride phase.

In the present invention, as shown in FIGS. 4A and 4B, by adopting a constitution selected from the three types of hard phases described above for the hard phase, insert hardness can be enhanced and wear resistance can be improved.

Moreover, Mo may be contained in one or both of the hard phase and the binding phase.

Since wettability of the hard phase and the binding phase is improved as a result of containing Mo, sintering can be improved. This Mo is contained in the peripheral portion of the first hard phase, the second hard phase, and the binding phase. Furthermore, Mo is preferably contained at, for example, 1 to 5 mass % converted as carbide ($Mo_2C$) based on the total weight of the insert.

The binding phase may also contain W at 40 to 60 mass % as a ratio in the binding phase.

In the case of containing W of 40 to 60 mass % as a ratio in the binding phase, the high-temperature hardness of the binding phase is improved. As a result, superior wear resistance can be demonstrated during, for example, high-speed cutting accompanying the generation of high levels of heat.

The cutting tool of the present invention includes a holder and the cermet insert of the present invention held and fixed by the holder.

Since the cutting tool of the present invention has the aforementioned cermet insert provided in the holder, superior wear resistance and breakage resistance can be realized.

EFFECTS OF THE INVENTION

In the first and the second aspects of the titanium carbonitride-based cermet insert of the present invention (also referred to as a cutting insert or cutting tip), the binding phase of the TiCN-based cermet that makes up the cutting insert contains a W component of 40 to 60% as a result of carrying out alternately changing atmosphere treatment in the heating process during sintering. As a result, since high-temperature hardness of the binding phase is dramatically improved, superior wear resistance is demonstrated during high-speed cutting accompanying the generation of high levels of heat.

In the third aspect of the cermet insert of the present invention, the ratios of the hard phase and the binding phase are optimized by defining the total amount of Ti, Ta/Nb and W; thereby allowing the obtaining of superior wear resistance and breakage resistance. Moreover, since 40 to 65 mass % of W is contained in the hard phase and the balance is contained in the binding phase, both high wear resistance and breakage resistance can be realized.

Since the cutting tool of the present invention includes the aforementioned cermet insert in the holder, superior wear resistance and breakage resistance can be realized.

BRIEF DESCRIPTION OF THE REFERENCE SYMBOLS

1, 11, 21: insert, 3: holder, 5: fixture, 7: cutting tool.

BEST MODE FOR CARRYING OUT THE INVENTION

The following provides an explanation of the constitution of the present invention with reference to the drawings.

First Embodiment

The titanium carbonitride-based cermet insert (to also be referred to as a cutting insert) of the present embodiment is formed from titanium carbonitride-based cermet. An example of a cutting insert is an ISO standard CNMG120412 tip-shaped insert 11 shown in FIG. 1.

This titanium carbonitride-based cermet is a sintered body of a compact having a blended composition containing, as percent by mass %, at least 20 to 30% of tungsten carbide, 5 to 10% of one kind or two kinds of tantalum carbide and niobium carbide (to also be referred to as TaC/NbC), 5 to 10% of Co, 5 to 10% of Ni and 50 to 60% of titanium carbonitride.

When the microstructure is observed with a scanning electron microscope, the aforementioned cermet can be seen to have a microstructure including 75 to 90 area % of a hard phase and the balance including a binding phase.

Figure 2:
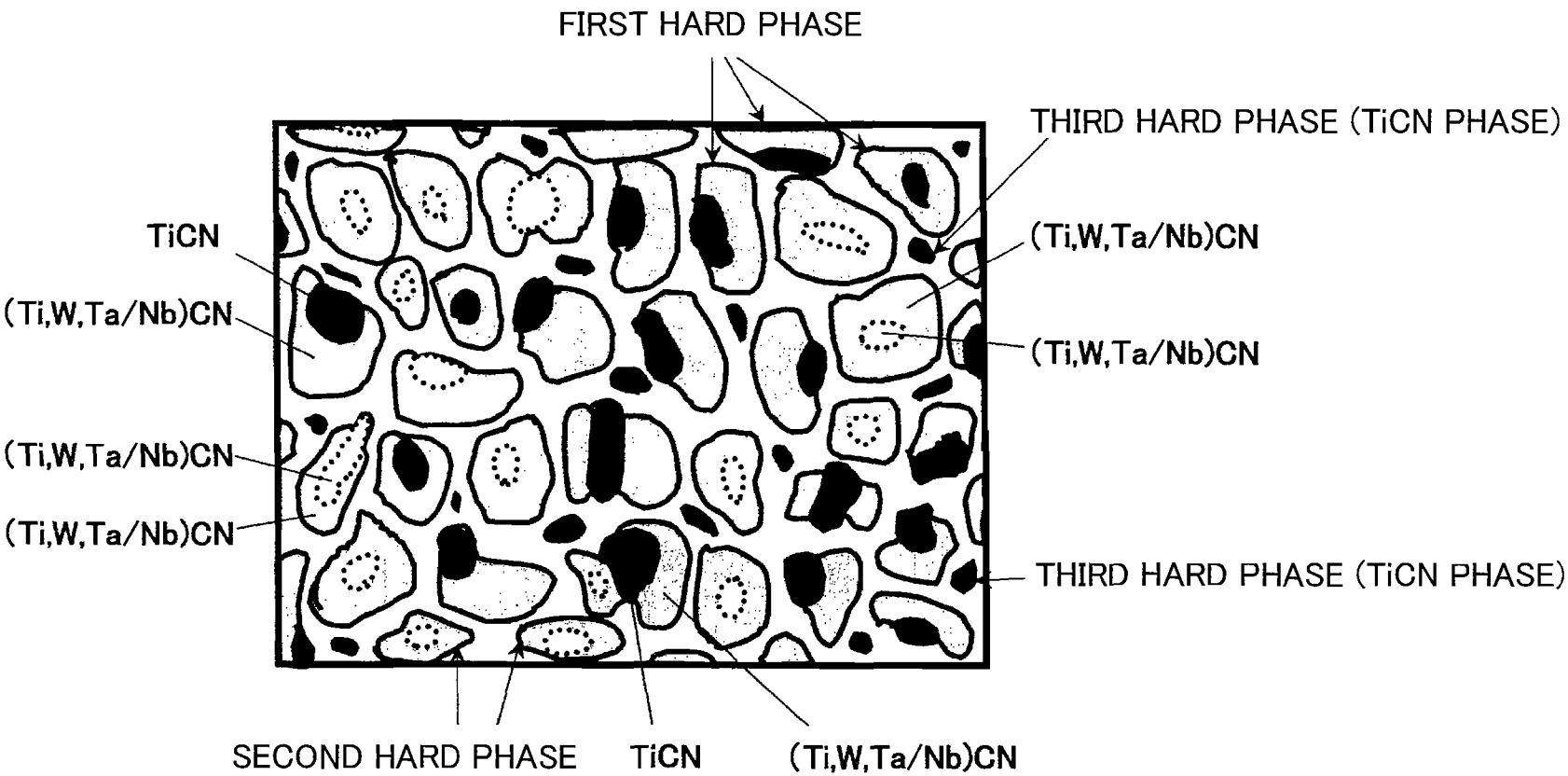
FIG. 2 is a schematic drawing showing the results of observing the structure of TiCN-based cermet which makes up a cutting insert according to the first embodiment with a scanning electron microscope (magnification: 10,000-fold).

The hard phase contains the following (1) to (3) as shown in the schematic drawing of FIG. 2.

(1) First hard phase having a core-having structure in which a core portion includes a titanium carbonitride phase and a peripheral portion includes a complex carbonitride phase having Ti, W and one kind or two kinds of Ta and Nb (hereinafter indicated as (Ti,W,Ta/Nb)CN).

(2) Second hard phase having a core-having structure in which both a core portion and a peripheral portion include (Ti,W,Ta/Nb)CN phases.

(3) Third hard phase having a single phase structure including a titanium carbonitride phase.

The binding phase contains a W—Co—Ni-based alloy having a composition including, as a ratio in the binding phase and by mass %, at least 18 to 33% of Co, 20 to 35% of Ni, Ti, and one kind or two kinds of Ta and Nb, the total amount thereof being 5% or less, and 40 to 60% of W.

The reasons for numerically limiting the blended composition of the TiCN-based cermet which makes up this cutting insert and the component composition of the binding phase as described above are explained below.

(WC of Compact and W of Binding Phase)

The WC powder serving as the raw material powder is put into solid solution in Co and Ni components serving as components that form the binding phase during sintering, and W is remained and contained in the binding phase during the aforementioned alternately changing atmosphere treatment; thereby, a binding phase having a high W content is formed. As a result, since the high-temperature hardness of the binding phase is improved, W acts to contribute to improvement of wear resistance during high-speed cutting by the cutting insert. If the blending ratio of WC is less than 20%, the ratio of W contained in the binding phase is less than 40% as the ratio in the binding phase. As a result, the desired wear resistance during high-speed cutting accompanying generation of high levels of heat cannot be demonstrated. On the other hand, if the blending ratio of WC exceeds 30%, the ratio of W component contained in the binding phase becomes excessively high, exceeding 60% as the ratio in the binding phase. As a result, high-temperature strength of the binding phase itself decreases, thereby causing increased susceptibility to the occurrence of breakage during cutting. On the basis of these factors, the blending ratio of WC is defined to be 20 to 30%, and the W component is defined to be contained at 40 to 60% in the binding phase of the TiCN-based cermet by the aforementioned alternately changing atmosphere treatment.

(Tac/Nbc of Compact and Ta/Nb of Binding Phase)

TaC powder and NbC powder similarly serving as raw material powder are also put into solid solution in Co and Ni components serving as components for forming the binding phase during sintering, and then precipitated during cooling to form a hard phase. Ta and Nb are contained in solid solution in the peripheral portion and a part of the core portion of the hard phase, and have the action of improving the high-temperature strength of the hard phase. However, if the blending ratio of one kind or two kinds of this TaC powder and NbC powder is less than 5%, the desired improving effect of the aforementioned action is not obtained. On the other hand, if the blending ratio thereof exceeds 10%, the ratio contained in the hard phase becomes excessively high. This not only causes a decrease in hardness of the hard phase, but also causes the ratio contained in the binding phase to become excessively high, exceeding 5% as the ratio of the total amount with Ti in the binding phase. As a result, high-temperature hardness decreases rapidly. On the basis of these factors, the blending ratio of one kind or two kinds of TaC and NbC is defined to be 5 to 10%, and the total amount of Ti and one kind or two kinds of Ta and Nb in the binding phase is defined to be 5% or less as the ratio in the binding phase.

(Co of Compact and Co of Binding Phase)

Co has the action of improving the strength of cutting inserts by improving sinterability and forming a binding phase. However, if the blending ratio thereof is less than 5%, not only can the desired sinterability not be secured, but the ratio of Co contained in the binding phase (ratio in the binding phase) ends up being less than 18%; thereby preventing the securing of the effect of improving strength of the aforementioned cutting insert. On the other hand, if the blending ratio thereof exceeds 10%, the ratio of Co contained in the binding phase after sintering ends up exceeding 33%. As a result, the high-temperature hardness of the binding phase decreases and wear progresses rapidly. On the basis of these factors, the blending ratio of Co is defined to be 5 to 10%, and the ratio of Co contained in the binding phase is defined to be 18 to 33%.

(Ni of Compact and Ni of Binding Phase)

Ni forms the binding phase together with Co during sintering; thereby improving heat resistance of the binding phase As a result, Ni has the action of contributing to improved wear resistance of the cutting insert. However, if the blending ratio thereof is less than 5%, the ratio of Ni component contained in the binding phase after sintering (ratio in the binding phase) ends up being less than 20%, thereby preventing the desired effect of improving heat resistance from being obtained. On the other hand, if the blending ratio thereof exceeds 10%, the ratio of Ni contained in the binding phase after sintering becomes excessively high in excess of 35%. As a result, high-temperature strength of the binding phase decreases, thereby resulting in increased susceptibility to breakage of the cutting edge. On the basis of these factors, the blending ratio of Ni is defined to be 5 to 10%, and the ratio of Ni contained in the binding phase is defined to be 20 to 35%.

(Ticn of Compact and Hard Phase)

Raw material powder in the form of TiCN powder forms a hard phase having the aforementioned first to third hard phases during sintering; thereby, improving the hardness of the cutting insert. As a result, TiCN has the action of contributing to improved wear resistance.

However, if the blending ratio of TiCN is less than 50%, the ratio of the hard phase in the cutting insert ends up being less than 75 area %, thereby preventing desired hardness from being secured. On the other hand, if the blending ratio of TiCN exceeds 60%, the ratio of the hard phase becomes excessively high exceeding 90 area %. As a result, the strength of the cutting insert decreases rapidly, resulting in increased susceptibility to breakage during cutting. Moreover, the total amount of Ti and one kind or two kinds of Ta and Nb in the binding phase ends up exceeding 5% as the ratio in the binding phase. As a result, the high-temperature hardness of the binding phase decreases, which causes accelerated wear during high-speed cutting. On the basis of these factors, the blending ratio of TiCN is defined to be 50 to 60%, and the total amount of Ti and one kind or two kinds of Ta and Nb in the binding phase is defined to be 5% or less as the ratio in the binding phase.

Second Embodiment

The titanium carbonitride-based cermet insert (to also be referred to as a cutting insert) of the present embodiment is a sintered body of a compact having a blended composition containing, as percent by mass %, at least 20 to 30% of tungsten carbide, 5 to 10% of one kind or two kinds of tantalum carbide and niobium carbide (to also be referred to as TaC/NbC), 1 to 5% of one kind or two kinds of zirconium carbide, vanadium carbide and molybdenum carbide (to also be referred to as ZrC/VC/$Mo_2C$), 5 to 10% of Co, 5 to 10% of Ni, and 50 to 60% of titanium carbonitride. An example of this cutting insert is an ISO standard CNMG120412 tip-shaped cutting insert 21 shown in FIG. 1.

When the microstructure is observed with a scanning electron microscope, the cutting insert can be seen to have a microstructure including 75 to 93 area % of a hard phase and the balance containing a binding phase.

Figure 3:
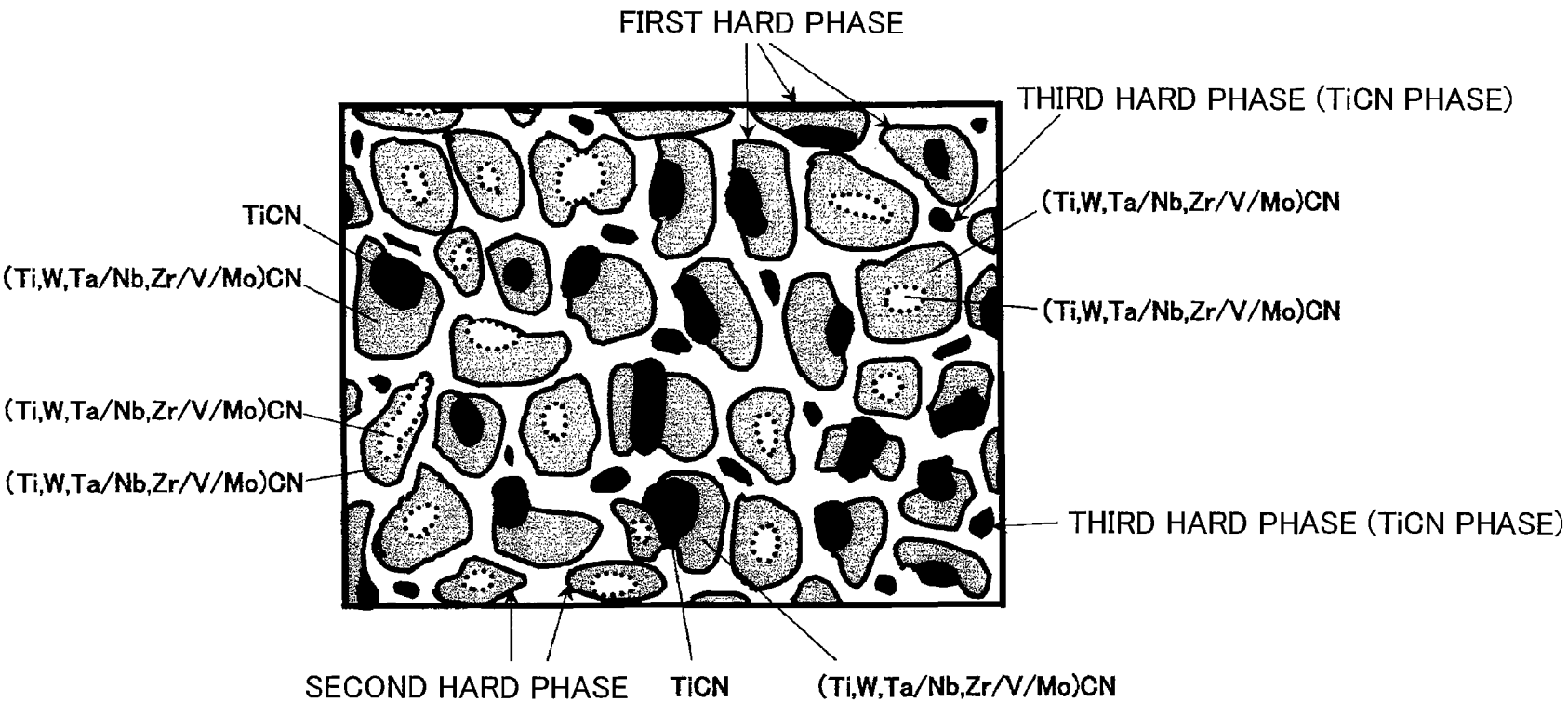
FIG. 3 is a schematic drawing showing the results of observing the structure of TiCN-based cermet which makes up a cutting insert according to the second embodiment with a scanning electron microscope (magnification: 10,000-fold).

The hard phase contains the following (1) to (3) as shown in the schematic drawing of FIG. 3.

(1) First hard phase having a core-having structure in which a core portion includes a titanium carbonitride phase, and a peripheral portion includes a complex carbonitride phase having Ti, W, one kind or two kinds of Ta and Nb, and one kind or two or more kinds of Zr, V and Mo (hereinafter indicated as (Ti,W,Ta/Nb,Zr/V/Mo)CN).

(2) Second hard phase having a core-having structure in which both a core portion and a peripheral portion include (Ti,W,Ta/Nb,Zr/V/Mo)CN phases.

(3) Third hard phase having a single phase structure including a titanium carbonitride phase.

The binding phase contains W—Co—Ni-based alloy having a composition including, as a ratio in the binding phase and by mass %, at least:

18 to 33% of Co;

20 to 35% of Ni;

Ti, one kind or two kinds of Ta and Nb, and one kind or two or more kinds of Zr, V and Mo, the total amount thereof being 5% or less; and 40 to 60% of W.

The reasons for numerically limiting the blended composition of the compact of the TiCN-based cermet making up this cutting insert and the component composition of the binding phase as described above are explained below.

(WC of Compact and W of Binding Phase)

The WC powder serving as the raw material powder is put into solid solution in Co and Ni components serving as components that form the binding phase during sintering, and W is remained and contained in the binding phase during the aforementioned alternately changing atmosphere treatment; thereby, a binding phase having a high W content is formed. As a result, since the high-temperature hardness of the binding phase is improved, W acts to contribute to improvement of wear resistance during high-speed cutting by the cutting insert. If the blending ratio of WC is less than 20%, the ratio of W contained in the binding phase is less than 40% as the ratio in the binding phase. As a result, the desired wear resistance during high-speed cutting accompanying generation of high levels of heat cannot be demonstrated. On the other hand, if the blending ratio of WC exceeds 30%, the ratio of W component contained in the binding phase becomes excessively high, exceeding 60% as the ratio in the binding phase. As a result, high-temperature strength of the binding phase itself decreases, thereby causing increased susceptibility to the occurrence of breakage during cutting On the basis of these factors, the blending ratio of WC is defined to be 20 to 30%, and the W component is defined to be contained at 40 to 60% in the binding phase of the TiCN-based cermet by the aforementioned alternately changing atmosphere treatment.

(TaC/NbC and ZrC/VC/$MO_2C$ of Compact and Ta/Nb and Zr/V/Mo of Binding Phase)

TaC/NbC powder similarly serving as raw material powder (to be referred to as the former) and ZrC/VC/$MO_2C$ powder (to be referred to as the latter) are also put into solid solution in Co and Ni components serving as components for forming the binding phase during sintering, and then precipitated during cooling to form a hard phase. They are contained in solid solution in the peripheral portion and a part of the core portion of the hard phase, the former has the action of improving the high-temperature strength of the hard phase, while the latter has the action of improving wettability with the binding phase. Consequently, both have the effect of improving the strength of the cermet itself. However, if the blending ratio of the former is less than 5%, or if the blending ratio of the latter is less than 1%, the desired improving effects of the aforementioned actions are not obtained. On the other hand, if the blending ratio of the former exceeds 10%, or if the blending ratio of the latter exceeds 5%, the ratio contained in the hard phase becomes excessively high. This not only causes a decrease in hardness of the hard phase, but also causes the total amount of Ti, Ta/Nb and Zr/V/Mo in the binding phase to be excessively high, exceeding 5% as the ratio in the binding phase. As a result, high-temperature hardness decreases rapidly. On the basis of these factors, the blending ratio of the former is defined to be 5 to 10%, that of the latter is defined to be 1 to 5%, and the total amount of Ti, Ta/Nb and Zr/V/Mo in the binding phase is defined to be 5% or less as the ratio in the binding phase (Co of Compact and Co of Binding Phase)

Co powder serving as a raw material powder has the action of improving the strength of cutting inserts by improving sinterability and forming a binding phase. However, if the blending ratio thereof is less than 5%, not only can the desired sinterability not be secured, but the ratio of Co contained in the binding phase (ratio in the binding phase) ends up being less than 18%; thereby preventing the securing of desired strength for the cutting insert. On the other hand, if the blending ratio thereof exceeds 10%, the ratio of Co contained in the binding phase after sintering ends up exceeding 33%. As a result, the high-temperature hardness of the binding phase decreases and wear progresses rapidly. On the basis of these factors, the blending ratio of Co is defined to be 5 to 10%, and the ratio of Co contained in the binding phase is defined to be 18 to 33%.

(Ni of Compact and Ni of Binding Phase)

Ni serving as a raw material powder forms the binding phase together with Co during sintering; thereby improving heat resistance of the binding phase. As a result, Ni has the action of contributing to improved wear resistance of the cutting insert. However, if the blending ratio thereof is less than 5%, the ratio of Ni component contained in the binding phase after sintering (ratio in the binding phase) ends up being less than 20%, thereby preventing the desired effect of improving heat resistance from being obtained. On the other hand, if the blending ratio thereof exceeds 10%, the ratio of Ni contained in the binding phase after sintering becomes excessively high in excess of 35%. As a result, high-temperature strength of the binding phase decreases, thereby resulting in increased susceptibility to breakage of the cutting edge. On the basis of these factors, the blending ratio of Ni is defined to be 5 to 10%, and the ratio of Ni contained in the binding phase is defined to be 20 to 35%.

(TiCN of Compact and Hard Phase)

Raw material powder in the form of TiCN powder forms a hard phase having the aforementioned first to third hard phases during sintering; thereby, improving the hardness of the cutting insert. As a result, TiCN has the action of contributing to improved wear resistance.

However, if the blending ratio of TiCN is less than 50%, the ratio of the hard phase in the cutting insert ends up being less than 75 area %, thereby preventing desired hardness from being secured. On the other hand, if the blending ratio of TiCN exceeds 60%, the ratio of the hard phase becomes excessively high exceeding 93 area %. As a result, the strength of the cutting insert decreases rapidly, resulting in increased susceptibility to breakage during cutting. Moreover, the total amount of Ti, Ta/Nb and Zr/V/Mo in the binding phase ends up exceeding 5% as the ratio in the binding phase. As a result, the high-temperature hardness of the binding phase decreases, which causes accelerated wear during high-speed cutting. On the basis of these factors, the blending ratio of TiCN is defined to be 50 to 60%, and the total amount of Ti, Ta/Nb and Zr/V/Mo in the binding phase is defined to be 5% or less as the ratio in the binding phase.

Third Embodiment

Figure 5:
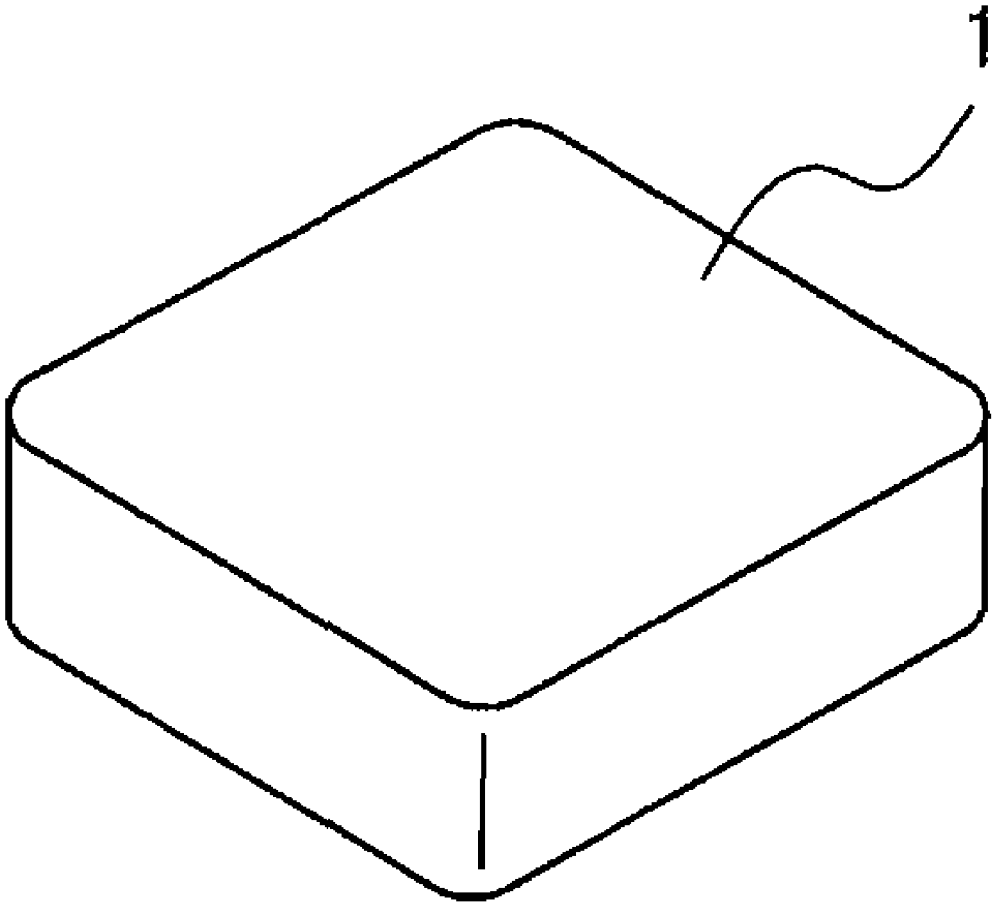
FIG. 5 is a perspective view showing a cermet insert according to the third embodiment.

Cermet insert 1 of the present embodiment is a cutting insert including an ISO standard SNGN120408 tip-shaped sintered body as shown in FIG. 5.

This insert 1 is formed from titanium carbonitride-based cermet including a sintered body containing Ti, one kind or two kinds of Ta and Nb (to also be referred to as Ta/Nb) and W.

The sintered body composition of the insert 1 is shown below.

The total of the amount of Ti converted as carbonitride, the amount of one kind or two kinds of Ta and Nb converted as carbide, and the amount of W converted as carbide is 70 to 95 mass % as the ratio to the entire constitution that makes up the sintered body.

In addition, the amount of W converted as carbide is 20 to 35 mass % as the ratio to the entire constitution, and the amount of Co and Ni is 5 to 30 mass % converted as the ratio to the entire constitution.

Ti is contained at 45 to 60 mass % converted as carbonitride based on the entire constitution, while one kind or two kinds of Ta and Nb are contained at 5 to 10 mass % converted as carbide based on the entire constitution.

Figure 4A:
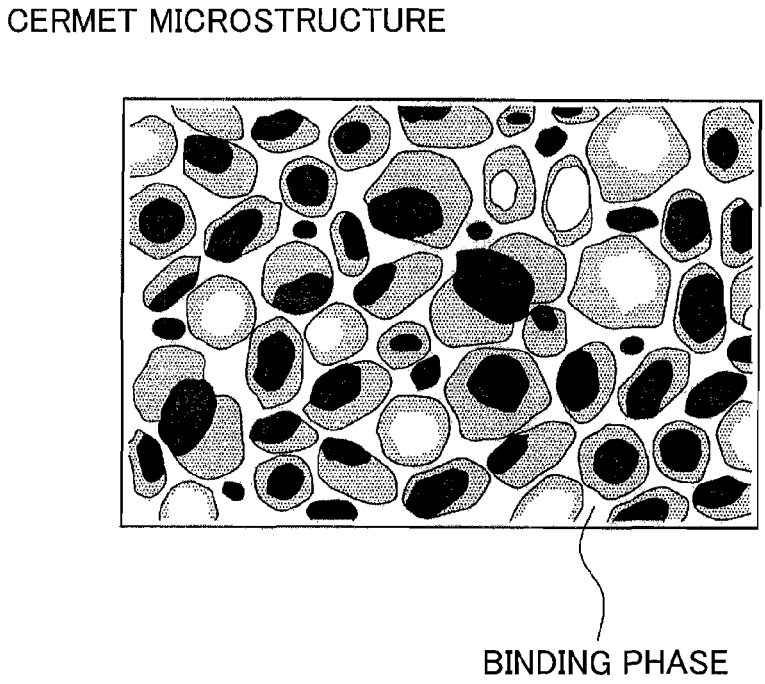
FIG. 4A is an explanatory drawing schematically showing a cross-section of a cermet insert according to the third embodiment.

As shown in FIG. 4A, this insert 1 includes a microstructure containing hard phases (hard particles) and binding phases present so as to cover the periphery thereof.

The hard phase includes a complex carbonitride containing Ti, W and one kind or two kinds of Ta and Nb (hereinafter indicated as (Ti,W,Ta/Nb)CN) and titanium carbonitride. The binding phase includes for main components thereof W and one kind or two kinds of Co and Ni (to also be referred to as (Co/Ni)).

Furthermore, "includes for main components thereof W and one kind or two kinds of Co and Ni" refers to indicating a state of the total amount thereof being more than the total amount of other components, reaching, for example, a total amount of 98 mass %.

40 to 65 mass % of the W contained in the entire constitution is contained in the hard phase, while the balance is contained in the binding phase.

Figure 4B:
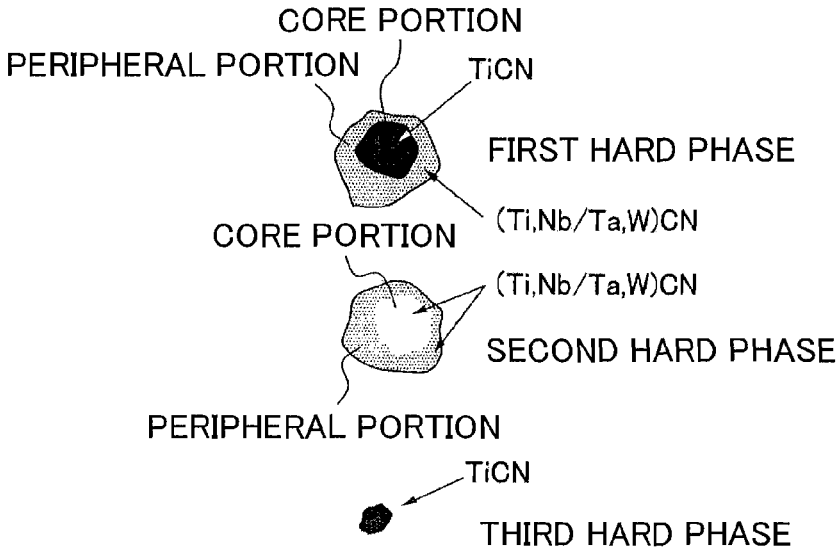
FIG. 4B is an explanatory drawing schematically showing a first hard phase, a second hard phase and a third hard phase which make up a hard phase.

The hard phase includes all of the hard phases of the following (1) to (3) as indicated in, for example, FIG. 4B.

(1) First hard phase having a core-having structure in which a core portion includes a titanium carbonitride phase and a peripheral portion includes a (Ti,W,Ta/Nb)CN phase.

(2) Second hard phase having a core-having structure in which both a core portion and a peripheral portion include (Ti,W,Ta/Nb)CN phases.

(3) Third hard phase having a single phase structure including a titanium carbonitride phase.

The reasons for numerically limiting the composition of the titanium carbonitride-based cermet making up this cutting insert and the component compositions of the hard phase and the binding phase as described above are explained below. Furthermore, the content of Ti is the amount converted as TiCN, the content of Nb and/or Ta is the amount converted as (Nb/Ta)C, and the content of W is the amount converted as WC.

Carbonitrides such as the complex carbonitride and titanium carbonitride that form the hard phase (hard particles) have the action of improving wear resistance by improving cermet hardness. However, if the ratio of the hard phase exceeds 95 mass % of the entire cermet, the relative ratio of the binding phase becomes less than 5 mass %, thereby causing a decrease in toughness and breakage resistance. On the other hand, if the ratio of the hard phase is less than 70 mass %, the relative ratio of the binding phase ends up exceeding 30 mass %, thereby lowering the wear resistance of the cermet. On the basis of these factors, the total of the amount of Ti converted as carbonitride, the amount of one kind or two kinds of Ta and Nb converted as carbide, and the amount of W converted as carbide is defined to be 70 to 95 mass % as the ratio to the entire constitution that makes up the sintered body.

In addition, the wear resistance of the insert can be improved by containing W at 20 to 35 mass % (converted as WC) based on the entire constitution.

Moreover, Co has the effect of improving the strength of the insert by improving sinterability and forming a binding phase. Ni has the effect of enhancing wear resistance of the insert by forming a binding phase during sintering and improving heat resistance of the binding phase. The aforementioned characteristics can be demonstrated by containing Co and Ni at a total amount of 5 to 30 mass %. The amount of Co and Ni is each preferably 5 mass % or more.

In the present embodiment in particular, in addition to W contained in the entire constitution being distributed at 40 to 65 mass % converted as carbide in the hard phase, the balance is distributed in the binding phase.

In other words, in the present embodiment, since the hard phase is strengthened as a result of containing 40 to 65 mass % of the W contained in the entire constitution in the hard phase in the form of a solid solution, breakage resistance (and particularly thermal shock resistance) is improved. Moreover, since the hardness of the binding phase increases as a result of containing the balance of the W in the binding phase, wear resistance is improved. As a result, the remarkable effect of being able to realize both high levels of wear resistance and breakage resistance is demonstrated.

Figure 6:
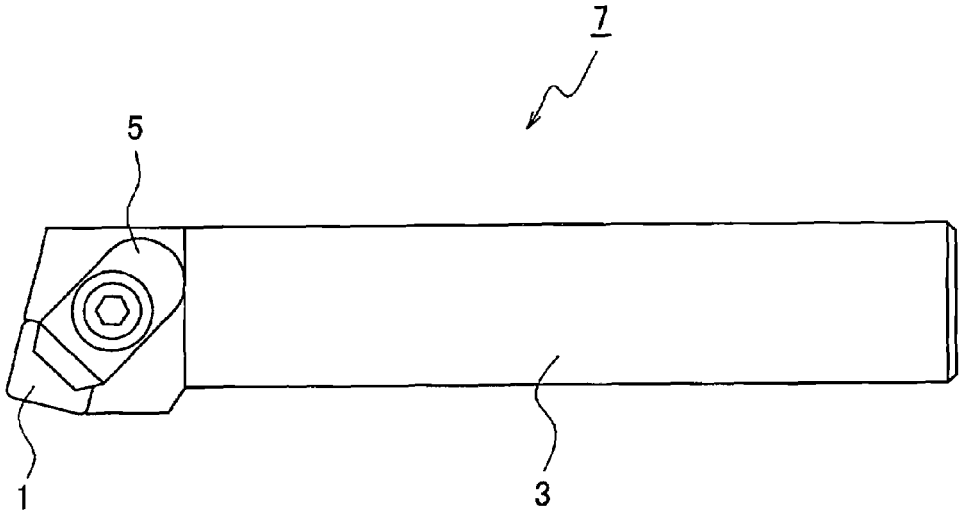
FIG. 6 is an explanatory drawing showing a cutting tool according to the third embodiment.

As shown in FIG. 6, the aforementioned insert 1 is fixed on the end of a steel, tool holder 3 by a fixture 5. A cutting tool 7, in which the insert 1 is fixed to the holder 3, is used for cutting a steel and the like.

Furthermore, the following constitution described in the first embodiment, for example, can be further employed in the present embodiment.

For example, "a sintered body of a compact having a blended composition containing at least 20 to 30 mass % of tungsten carbide, 5 to 10 mass % of one kind or two kinds of tantalum carbide and niobium carbide, 5 to 10 mass % of Co, 5 to 10 mass % of Ni and 50 to 60% mass % of titanium carbonitride" can be employed as an insert.

Moreover, "a constitution having a microstructure including 75 to 90 area % of a hard phase and the balance containing a binding phase when the microstructure is observed with a scanning electron microscope", for example, can be employed as the aforementioned sintered body.

What is more, "a W—Co—Ni-based alloy having a composition containing, as a ratio in the binding phase, at least 18 to 33 mass % of Co, 20 to 35 mass % of Ni, Ti and one kind or two kinds of Ta and Nb, the total amount thereof being 5 mass % or less, and 40 to 60 mass % of W", for example, can be employed as the aforementioned binding phase.

Furthermore, unavoidable impurities are normally contained in the balance of the composition. In addition, in the present description, the term "A and/or B" refers to at least one of A and B.

EXAMPLES

Example 1

The following provides a more detailed explanation of the cutting insert of the first embodiment through an example thereof.

$TiC_{0.5}N_{0.5}$ powder, $TiC_{0.3}N_{0.7}$ powder, $TiC_{0.15}N_{0.85}$ powder (wherein, C/N indicates the atomic ratio), NbC powder, TaC powder, WC powder, Co powder and Ni powder, each having a mean particle diameter of 0.5 to 2 μm, were prepared for use as raw material powders. These raw material powders were blended in the blended compositions shown in Table 1 and then were subjected to wet mixing for 24 hours with a ball mill and drying. Subsequently, the blended compositions were pressed into compacts at a pressure of 98 MPa, and the compacts were sintered under the following sintering conditions (a) to (e).

(a) The temperature was raised from room temperature to 1280° C. at the rate of 2° C./min. in a vacuum atmosphere at 10 Pa or less.

(b) At the point the temperature had risen to 1280° C., alternately changing atmosphere treatment was carried out by repeatedly alternating between holding in an Ar atmosphere for a short period of time which includes holding for 2 minutes in an Ar atmosphere at 35 kPa, and holding in a vacuum atmosphere for a short period of time which includes holding for 10 minutes in a vacuum atmosphere at 10 Pa or less, each for the number of times indicated in Table 1.

(c) After the aforementioned alternately changing atmosphere treatment, the temperature was raised to 1420° C. at the rate of 2° C./min in a vacuum atmosphere at 10 Pa or less.

(d) The temperature was raised from 1420° C. to a predetermined sintering temperature within a range of 1480 to 1560° C. at the rate of 2° C./min, and then the temperature was held at the aforementioned sintering temperature for 1.5 hours. Raising the temperature to the sintering temperature and holding at the sintering temperature were carried out in a nitrogen atmosphere at 1300 Pa.

(e) Cooling of the furnace from the aforementioned sintering temperature was carried out in a vacuum atmosphere at 10 Pa or less.

Figure 1:
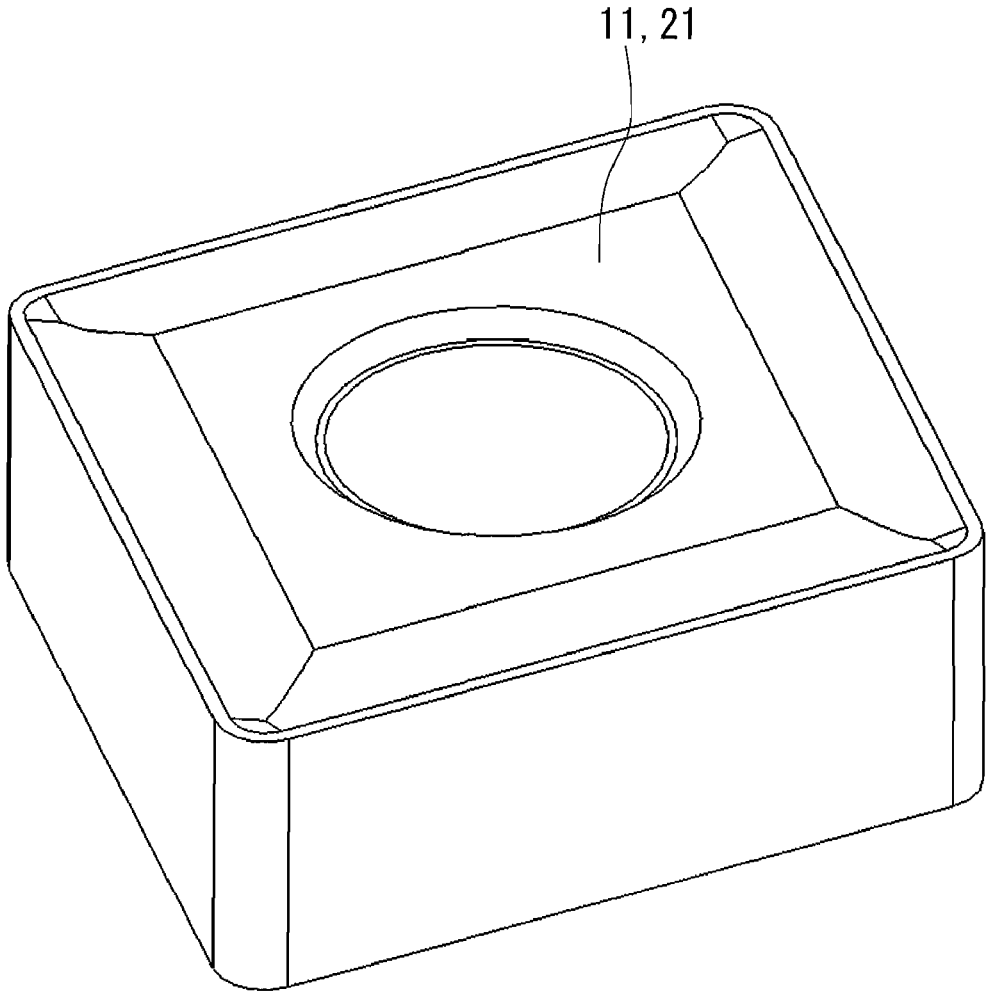
FIG. 1 is a perspective view of an example of a cermet insert according to a first and a second embodiments.

After sintering, cutting inserts 1-1 to 1-10 in accordance with the first embodiment of the present invention were respectively produced in the shape of an ISO standard CNMG120412 tip as shown in FIG. 1 by carrying out honing processing at R=0.07 on the cutting edge.

In addition, conventional cutting inserts 1-1 to 1-10 were respectively produced under substantially the same conditions with the exception of not carrying out the aforementioned alternately changing atmosphere treatment during the process of raising the temperature to the sintering temperature as shown in Table 2 for the purpose of comparison.

The results of observing the microstructures of TiCN-based cermets making up the resulting the cutting inserts 1-1 to 1-10 of the present invention and the conventional cutting inserts 1-1 to 1-10 with a scanning electron microscope, and the results of analyzing their binding phases, are shown in Tables 3 and 4, respectively.

Next, the cutting inserts 1-1 to 1-10 of the present invention and the conventional cutting inserts 1-1 to 1-10 were subjected to a high-speed cutting test of alloy steel under the following cutting conditions 1-A to 1-C while bolted to the end of a steel shank tool holder with a fixture. The width of flank wear of the cutting edge was measured in each cutting test. The measurement results are shown in Table 5.

Cutting Conditions 1-A (Dry, Intermittent, High-Speed Cutting Test of Alloy Steel):

Cut material: Round bar containing four longitudinal slits at equal intervals in the direction of length made of JIS SCM440;

Cutting speed: 300 m/min;

Depth of cut: 1.5 mm;

Feed rate: 0.2 mm/rev; and

Cutting time: 10 minutes (ordinary cutting speed: 200 m/min).

Cutting Conditions 1-B (Dry, Continuous, High-Speed Cutting Test of Carbon Steel):

Cut material: Round bar made of JIS S20C;

Cutting speed: 350 m/min;

Depth of cut: 1.0 mm;

Feed rate: 0.2 mm/rev; and

Cutting time: 20 minutes (ordinary cutting speed: 250 m/min).

Cutting Conditions 1-C (Dry, Continuous, High-Speed Cutting Test of Cast Iron):

Cut material: Round bar made of JIS FC300;

Cutting speed: 400 m/min;

Depth of cut: 2.5 mm;

Feed rate: 0.3 mm/rev; and

Cutting time: 20 minutes (ordinary cutting speed: 280 m/min).

TABLE 1

| | | Blended Composition | | | | | | | | Alternately Changing Atmosphere Treatment during Heating Process | |
|---|---|---|---|---|---|---|---|---|---|---|---|
| Type | | $TiC_{0.5}N_{0.5}$ | $TiC_{0.3}N_{0.7}$ | $TiC_{0.15}N_{0.85}$ | WC | TaC | NbC | Co | Ni | Number of times held in Ar for short period of time | Number of times held in vacuum for short period of time |
| Cutting inserts of present invention | 1-1 | 25 | 25 | — | 20 | 10 | — | 10 | 10 | 2 | 2 |
| | 1-2 | — | 25 | 25 | 25 | — | 5 | 10 | 10 | 2 | 3 |
| | 1-3 | 35 | — | 15 | 30 | 5 | 5 | 5 | 5 | 3 | 2 |
| | 1-4 | 35 | 20 | — | 25 | — | 7 | 6 | 7 | 3 | 3 |
| | 1-5 | — | 45 | 10 | 25 | 10 | — | 5 | 5 | 3 | 4 |
| | 1-6 | 15 | — | 40 | 30 | 1 | 4 | 5 | 5 | 4 | 3 |
| | 1-7 | 10 | 50 | — | 20 | 5 | — | 6 | 9 | 4 | 4 |
| | 1-8 | — | 30 | 30 | 20 | 4 | 3 | 8 | 5 | 5 | 4 |
| | 1-9 | 40 | — | 20 | 25 | — | 5 | 5 | 5 | 5 | 5 |
| | 1-10 | 20 | 20 | 20 | 20 | — | 7 | 6 | 7 | 6 | 6 |

TABLE 2

| | | Blended Composition | | | | | | | | Alternately Changing Atmosphere Treatment during Heating Process | |
|---|---|---|---|---|---|---|---|---|---|---|---|
| Type | | $TiC_{0.5}N_{0.5}$ | $TiC_{0.3}N_{0.7}$ | $TiC_{0.15}N_{0.85}$ | WC | TaC | NbC | Co | Ni | Number of times held in Ar for short period of time | Number of times held in vacuum for short period of time |
| Conventional cutting inserts | 1-1 | 50 | — | — | 20 | 10 | — | 10 | 10 | — | — |
| | 1-2 | 50 | — | — | 25 | — | 5 | 10 | 10 | — | — |
| | 1-3 | 50 | — | — | 30 | 5 | 5 | 5 | 5 | — | — |
| | 1-4 | 55 | — | — | 25 | — | 7 | 6 | 7 | — | — |
| | 1-5 | 55 | — | — | 25 | 10 | — | 5 | 5 | — | — |
| | 1-6 | 55 | — | — | 30 | 1 | 4 | 5 | 5 | — | — |
| | 1-7 | 60 | — | — | 20 | 5 | — | 6 | 9 | — | — |
| | 1-8 | 60 | — | — | 20 | 4 | 3 | 8 | 5 | — | — |
| | 1-9 | 60 | — | — | 25 | — | 5 | 5 | 5 | — | — |
| | 1-10 | 60 | — | — | 20 | — | 7 | 6 | 7 | — | — |

TABLE 3

| Type | | TiCN-based Cermet: Microstructure (area %) Hard phase | Binding phase | Component Composition of Binding Phase (mass %) Co | Ni | Ti | Ta | Nb | W |
|---|---|---|---|---|---|---|---|---|---|
| Cutting inserts of present invention | 1-1 | 75.1 | Balance | 29.0 | 29.5 | 0.6 | 0.5 | — | 40.2 |
| | 1-2 | 78.7 | Balance | 28.5 | 29.4 | 0.6 | — | 0.4 | 40.9 |
| | 1-3 | 84.9 | Balance | 18.1 | 20.0 | 1.0 | 0.6 | 0.4 | 59.8 |
| | 1-4 | 84.7 | Balance | 21.7 | 25.2 | 1.1 | — | 0.9 | 51.0 |
| | 1-5 | 89.8 | Balance | 27.5 | 27.9 | 2.0 | 0.8 | — | 41.7 |
| | 1-6 | 86.7 | Balance | 19.8 | 20.1 | 1.9 | 0.5 | 0.8 | 56.6 |
| | 1-7 | 85.0 | Balance | 22.0 | 34.8 | 2.0 | 0.9 | — | 40.1 |
| | 1-8 | 86.6 | Balance | 32.9 | 20.5 | 2.5 | 0.7 | 0.8 | 42.5 |
| | 1-9 | 88.4 | Balance | 22.4 | 22.5 | 2.7 | — | 1.4 | 50.7 |
| | 1-10 | 86.7 | Balance | 27.4 | 23.5 | 3.0 | — | 1.9 | 43.9 |

TABLE 4

| Type | | TiCN-based Cermet: Microstructure (area %) Hard phase | Binding phase | Component Composition of Binding Phase (mass %) Co | Ni | Ti | Ta | Nb | W |
|---|---|---|---|---|---|---|---|---|---|
| Conventional cutting inserts | 1-1 | 83.1 | Balance | 1.1 | 0.5 | 0.6 | — | 49.0 | 48.7 |
| | 1-2 | 84.2 | Balance | 2.3 | 0.6 | — | 0.3 | 48.2 | 48.3 |
| | 1-3 | 91.5 | Balance | 8.4 | 1.1 | 0.5 | 0.5 | 44.5 | 44.6 |
| | 1-4 | 90.0 | Balance | 3.4 | 1.0 | — | 0.9 | 51.0 | 43.5 |
| | 1-5 | 91.8 | Balance | 9.9 | 2.2 | 1.0 | — | 43.6 | 43.2 |
| | 1-6 | 91.9 | Balance | 8.3 | 2.0 | 0.4 | 0.7 | 44.4 | 44.1 |
| | 1-7 | 88.8 | Balance | 2.5 | 1.9 | 0.9 | — | 59.9 | 34.5 |
| | 1-8 | 90.1 | Balance | 6.5 | 2.1 | 0.5 | 1.1 | 35.0 | 54.6 |
| | 1-9 | 92.8 | Balance | 4.3 | 2.5 | — | 1.7 | 45.8 | 45.5 |
| | 1-10 | 90.1 | Balance | 9.2 | 3.1 | — | 1.9 | 46.2 | 39.5 |

TABLE 5

| Type | | Width of Flank Wear (mm): Cutting conditions 1-A | Cutting conditions 1-B | Cutting conditions 1-C | Type | | Width of Flank Wear (mm): Cutting conditions 1-A | Cutting conditions 1-B | Cutting conditions 1-C |
|---|---|---|---|---|---|---|---|---|---|
| Cutting inserts of present invention | 1-1 | 0.11 | 0.16 | 0.25 | Conventional cutting inserts | 1-1 | 0.38 | 0.37 | 0.47 |
| | 1-2 | 0.15 | 0.18 | 0.20 | | 1-2 | 0.37 | 0.36 | 0.47 |
| | 1-3 | 0.13 | 0.17 | 0.25 | | 1-3 | 0.38 | 0.39 | 0.49 |
| | 1-4 | 0.15 | 0.15 | 0.24 | | 1-4 | 0.36 | 0.38 | 0.48 |
| | 1-5 | 0.13 | 0.19 | 0.21 | | 1-5 | 0.37 | 0.38 | 0.46 |
| | 1-6 | 0.12 | 0.17 | 0.21 | | 1-6 | 0.40 | 0.37 | 0.45 |
| | 1-7 | 0.12 | 0.16 | 0.20 | | 1-7 | 0.36 | 0.42 | 0.49 |
| | 1-8 | 0.10 | 0.19 | 0.21 | | 1-8 | 0.37 | 0.39 | 0.51 |
| | 1-9 | 0.14 | 0.16 | 0.22 | | 1-9 | 0.39 | 0.41 | 0.45 |
| | 1-10 | 0.13 | 0.17 | 0.24 | | 1-10 | 0.34 | 0.41 | 0.49 |

Based on the results shown in Tables 1 to 5, in all of the cutting inserts 1-1 to 1-10 of the present invention, the binding phase of the TiCN-based cermet making up these cutting inserts contained W at a high content of 40 to 60% as the ratio in the binding phase; thereby, the cutting inserts were provided with superior high-temperature hardness, as a result, the cutting inserts were determined to demonstrate superior wear resistance even during high-temperature cutting accompanying generation of high levels of heat. In contrast, in the conventional cutting inserts 1-1 to 1-10, the ratio of W contained in the binding phase was low at 1 to 10% as the ratio in the binding phase in all of these cutting inserts. As a result, the binding phase cannot be expected to demonstrate superior high-temperature hardness. Consequently, it is clear that progression of wear of the binding phase is accelerated particularly during high-speed cutting, thereby leading to a comparatively short service life.

As has been described above, a cutting insert of the present invention demonstrates superior wear resistance not only during cutting under ordinary conditions such as when cutting various types of steel and cast iron, but also during high-speed cutting accompanying the generation of high levels of heat. Consequently, this cutting insert is able to adequately accommodate conservation of power, conservation of energy and reduction of costs.

Example 2

The following provides a more detailed explanation of the cutting insert of the second embodiment through an example thereof.

$TiC_{0.5}N_{0.5}$ powder, $TiC_{0.3}N_{0.7}$ powder, $TiC_{0.15}N_{0.85}$ powder (wherein, C/N indicates the atomic ratio), NbC powder, TaC powder, WC powder, TaC powder, NbC powder, ZrC powder, VC powder, $Mo_2C$ powder, Co powder and Ni powder, each having a mean particle diameter of 0.5 to 2 μm, were prepared for use as raw material powders. These raw material powders were blended in the blended compositions shown in Table 6 and then were subjected to wet mixing for 24 hours with a ball mill and drying. Subsequently, the blended compositions were pressed into compacts at a pressure of 98 MPa, and the compacts were sintered under the following sintering conditions (a) to (e).

(a) The temperature was raised from room temperature to 1280° C. at the rate of 2° C./min. in a vacuum atmosphere at 10 Pa or less.

(b) At the point the temperature had risen to 1280° C., alternately changing atmosphere treatment was carried out by repeatedly alternating between holding in an Ar atmosphere for a short period of time which includes holding for 2 minutes in an Ar atmosphere at 35 kPa, and holding in a vacuum atmosphere for a short period of time which includes holding for 10 minutes in a vacuum atmosphere at 10 Pa or less, each for the number of times indicated in Table 6.

(c) After the aforementioned alternately changing atmosphere treatment, the temperature was raised to 1420° C. at the rate of 2° C./min in a vacuum atmosphere at 10 Pa or less.

(d) The temperature was raised from 1420° C. to a predetermined sintering temperature within a range of 1480 to 1560° C. at a rate of 2° C./min, and then the temperature was held at the aforementioned sintering temperature for 1.5 hours. Raising the temperature to the sintering temperature and holding at the sintering temperature were carried out in a nitrogen atmosphere at 1300 Pa.

(e) Cooling of the furnace from the aforementioned sintering temperature was carried out in a vacuum atmosphere at 10 Pa or less.

After sintering, cutting inserts 2-1 to 2-15 in accordance with the second embodiment of the present invention were respectively produced in the shape of an ISO standard CNMG120412 tip as shown in FIG. 1 by carrying out honing processing at R=0.07 on the cutting edge.

In addition, conventional cutting inserts 2-1 to 2-15 were respectively produced under substantially the same conditions with the exception of using only the aforementioned $TiC_{0.5}N_{0.5}$ powder for the TiCN powder used as a raw material powder, and not carrying out the aforementioned alternately changing atmosphere treatment during the process of raising the temperature to the sintering temperature as shown in Table 7 for the purpose of comparison.

The results of observing the microstructure of TiCN-based cermet making up the resulting the cutting inserts 2-1 to 2-15 of the present invention and the conventional cutting inserts 2-1 to 2-15 with a scanning electron microscope, and the results of analyzing their binding phases, are shown in Tables 8 and 9, respectively.

Next, the cutting inserts 2-1 to 2-15 of the present invention and the conventional cutting inserts 2-1 to 2-15 were subjected to a high-speed cutting test of alloy steel under the following cutting conditions 2-A to 2-C while bolted to the end of a steel shank tool holder with a fixture. The width of flank wear of the cutting edge was measured in each cutting test. The measurement results are shown in Table 10.

Cutting Conditions 2-A (Dry, Intermittent, High-Speed Cutting Test of Carbon Steel):

Cut material: Round bar containing four longitudinal slits at equal intervals in the direction of length made of JIS S20C;

Cutting speed: 380 m/min;

Depth of cut: 1.5 mm;

Feed rate: 0.2 mm/rev; and

Cutting time: 10 minutes (ordinary cutting speed: 250 m/min).

Cutting Conditions 2-B (Dry, Continuous, High-Speed Cutting Test of Alloy Steel):

Cut material: Round bar made of JIS SCM440;

Cutting speed: 300 m/min;

Depth of cut: 1 mm;

Feed rate: 0.2 mm/rev; and

Cutting time: 20 minutes (ordinary cutting speed: 200 m/min)

Cutting Conditions 2-C (Dry, Continuous, High-Speed Cutting Test of Cast Iron):

Cut material: Round bar made of JIS FC300;

Cutting speed: 380 m/min;

Depth of cut: 2.5 mm;

Feed rate: 0.3 mm/rev; and

Cutting time: 20 minutes (ordinary cutting speed: 280 m/min)

TABLE 6

| | | Blended Composition | | | | | | | | | | | Alternately Changing Atmosphere Treatment during Heating Process | |
|---|---|---|---|---|---|---|---|---|---|---|---|---|---|---|
| Type | | $TiC_{0.5}N_{0.5}$ | $TiC_{0.3}N_{0.7}$ | $TiC_{0.15}N_{0.85}$ | WC | TaC | NbC | ZrC | VC | $Mo_2C$ | Co | Ni | Number of times held in Ar for short period of time | Number of times held in vacuum for short period of time |
| Cutting inserts of present invention | 2-1 | 20 | 33 | — | 20 | — | 5 | — | 2 | — | 10 | 10 | 2 | 2 |
| | 2-2 | 25 | — | 25 | 22 | 6 | — | 1 | — | 1 | 10 | 10 | 2 | 2 |
| | 2-3 | — | 35 | 15 | 25 | 5 | 2 | 3 | — | — | 7 | 8 | 3 | 2 |
| | 2-4 | 17 | 17 | 17 | 28 | — | 6 | — | — | 2 | 6 | 7 | 3 | 2 |
| | 2-5 | 10 | — | 42 | 30 | 5 | — | 1 | 1 | 1 | 5 | 5 | 3 | 3 |
| | 2-6 | 35 | 21 | — | 20 | 3 | 3 | — | 2 | 1 | 7 | 8 | 4 | 3 |
| | 2-7 | 40 | — | 14 | 22 | — | 7 | 2 | — | — | 9 | 6 | 4 | 3 |
| | 2-8 | — | 20 | 35 | 25 | 6 | — | 2 | 1 | 2 | 5 | 6 | 5 | 3 |
| | 2-9 | 10 | 34 | 10 | 28 | — | 5 | 1 | 1 | 1 | 5 | 5 | 5 | 4 |
| | 2-10 | 28 | 28 | — | 28 | — | 5 | — | 1 | — | 5 | 5 | 6 | 4 |
| | 2-11 | 15 | 42 | — | 20 | 7 | — | — | — | 3 | 5 | 8 | 2 | 4 |
| | 2-12 | 20 | 20 | 20 | 22 | 1 | 4 | — | 3 | — | 5 | 5 | 2 | 5 |
| | 2-13 | 28 | — | 30 | 24 | — | 5 | 1 | 1 | 1 | 5 | 5 | 3 | 5 |
| | 2-14 | — | 10 | 49 | 21 | 5 | — | 5 | — | — | 5 | 5 | 3 | 5 |
| | 2-15 | — | 13 | 45 | 20 | 4 | 3 | — | 4 | 1 | 5 | 5 | 3 | 6 |

TABLE 7

| Type | | Blended Composition | | | | | | | | | | | Alternately Changing Atmosphere Treatment during Heating Process | |
|---|---|---|---|---|---|---|---|---|---|---|---|---|---|---|
| | | $TiC_{0.5}N_{0.5}$ | $TiC_{0.3}N_{0.7}$ | $TiC_{0.15}N_{0.85}$ | WC | TaC | NbC | ZrC | VC | $Mo_2C$ | Co | Ni | Number of times held in Ar for short period of time | Number of times held in vacuum for short period of time |
| Conventional cutting inserts | 2-1 | 53 | — | — | 20 | — | 5 | — | 2 | — | 10 | 10 | — | — |
| | 2-2 | 50 | — | — | 22 | 6 | — | 1 | — | 1 | 10 | 10 | — | — |
| | 2-3 | 50 | — | — | 25 | 5 | 2 | 3 | — | — | 7 | 8 | — | — |
| | 2-4 | 51 | — | — | 28 | — | 6 | — | — | 2 | 6 | 7 | — | — |
| | 2-5 | 52 | — | — | 30 | 5 | — | 1 | 1 | 1 | 5 | 5 | — | — |
| | 2-6 | 56 | — | — | 20 | 3 | 3 | — | 2 | 1 | 7 | 8 | — | — |
| | 2-7 | 54 | — | — | 22 | — | 7 | 2 | — | — | 9 | 6 | — | — |
| | 2-8 | 55 | — | — | 25 | 6 | — | — | 1 | 2 | 5 | 6 | — | — |
| | 2-9 | 54 | — | — | 28 | — | 5 | 1 | 1 | 1 | 5 | 5 | — | — |
| | 2-10 | 56 | — | — | 28 | — | 5 | — | 1 | — | 5 | 5 | — | — |
| | 2-11 | 57 | — | — | 20 | 7 | — | — | — | 3 | 5 | 8 | — | — |
| | 2-12 | 60 | — | — | 22 | 1 | 4 | — | 3 | — | 5 | 5 | — | — |
| | 2-13 | 58 | — | — | 24 | — | 5 | 1 | 1 | 1 | 5 | 5 | — | — |
| | 2-14 | 59 | — | — | 21 | 5 | — | 5 | — | — | 5 | 5 | — | — |
| | 2-15 | 58 | — | — | 20 | 4 | 3 | — | 4 | 1 | 5 | 5 | — | — |

TABLE 8

| Type | | TiCN-based Cermet | | | | | | | | | | |
|---|---|---|---|---|---|---|---|---|---|---|---|---|
| | | Microstructure (area %) | | Component Composition of Binding Phase (mass %) | | | | | | | | |
| | | Hard phase | Binding phase | Co | Ni | Ti | Ta | Nb | Zr | V | Mo | W |
| Cutting Inserts of Present Invention | 2-1 | 79.6 | Balance | 28.6 | 28.6 | 1.1 | — | 0.6 | — | 0.4 | — | 40.5 |
| | 2-2 | 75.2 | Balance | 27.0 | 27.3 | 1.0 | 0.6 | — | 0.2 | — | 0.2 | 45.5 |
| | 2-3 | 80.5 | Balance | 20.2 | 23.2 | 0.6 | 0.4 | 0.3 | 0.5 | — | — | 54.5 |
| | 2-4 | 81.1 | Balance | 18.1 | 20.2 | 1.0 | — | 0.5 | — | 0.6 | 0.2 | 59.8 |
| | 2-5 | 88.2 | Balance | 24.6 | 24.9 | 1.8 | 0.8 | — | 0.4 | 0.9 | 0.3 | 46.5 |
| | 2-6 | 83.5 | Balance | 22.9 | 26.1 | 1.5 | 0.8 | 1.1 | — | — | 0.5 | 46.0 |
| | 2-7 | 84.4 | Balance | 32.9 | 22.8 | 1.1 | — | 0.7 | 0.2 | 0.2 | — | 42.0 |
| | 2-8 | 85.6 | Balance | 18.5 | 22.4 | 0.6 | 1.1 | — | — | 0.3 | 0.3 | 56.6 |
| | 2-9 | 89.4 | Balance | 27.2 | 27.6 | 1.2 | — | 1.6 | 0.3 | 0.5 | 0.2 | 41.2 |
| | 2-10 | 89.5 | Balance | 27.9 | 27.6 | 1.0 | — | 1.3 | — | — | — | 41.6 |
| | 2-11 | 86.5 | Balance | 21.9 | 34.9 | 0.7 | 0.7 | — | — | — | 0.5 | 41.1 |
| | 2-12 | 92.9 | Balance | 27.6 | 27.4 | 1.8 | 0.5 | 1.3 | — | 1.0 | — | 40.1 |
| | 2-13 | 88.4 | Balance | 22.1 | 22.6 | 1.5 | — | 1.6 | 0.6 | 0.5 | 0.6 | 50.3 |
| | 2-14 | 87.4 | Balance | 20.3 | 20.7 | 0.6 | 0.6 | — | 0.4 | — | — | 57.3 |
| | 2-15 | 87.8 | Balance | 20.6 | 20.5 | 1.9 | 1.3 | 0.9 | — | 0.5 | 0.2 | 53.9 |

TABLE 9

| Type | | TiCN-based Cermet | | | | | | | | | | |
|---|---|---|---|---|---|---|---|---|---|---|---|---|
| | | Microstructure (area %) | | Component Composition of Binding Phase (mass %) | | | | | | | | |
| | | Hard phase | Binding phase | W | Ti | Ta | Nb | Zr | V | Mo | Ni | Co |
| Conventional cutting Inserts | 2-1 | 84.6 | Balance | 4.2 | 1.0 | — | 0.5 | — | 0.3 | — | 46.8 | 47.0 |
| | 2-2 | 84.0 | Balance | 1.8 | 1.2 | 0.4 | — | 0.2 | — | 0.2 | 48.1 | 47.8 |
| | 2-3 | 88.0 | Balance | 1.9 | 0.9 | 0.4 | 0.3 | 0.3 | — | — | 51.3 | 44.6 |
| | 2-4 | 89.4 | Balance | 6.0 | 0.9 | — | 0.5 | — | — | 0.5 | 49.2 | 42.5 |

TABLE 9-continued

| Type | TiCN-based Cermet | | | | | | | | | | |
|---|---|---|---|---|---|---|---|---|---|---|---|
| | Microstructure (area %) | | Component Composition of Binding Phase (mass %) | | | | | | | | |
| | Hard phase | Binding phase | W | Ti | Ta | Nb | Zr | V | Mo | Ni | Co |
| 2-5 | 91.9 | Balance | 2.1 | 1.6 | 0.9 | — | 0.6 | 0.4 | 0.3 | 46.7 | 47.1 |
| 2-6 | 88.3 | Balance | 7.9 | 1.3 | 0.8 | 1.0 | — | 1.1 | 0.8 | 46.3 | 40.5 |
| 2-7 | 88.5 | Balance | 4.1 | 1.0 | — | 0.6 | 0.4 | — | — | 35.2 | 58.8 |
| 2-8 | 91.3 | Balance | 3.4 | 1.1 | 0.9 | — | — | 0.2 | 0.2 | 51.7 | 42.4 |
| 2-9 | 91.9 | Balance | 9.9 | 1.2 | — | 1.7 | 0.3 | 0.2 | 0.4 | 43.1 | 43.0 |
| 2-10 | 92.2 | Balance | 4.3 | 0.9 | — | 1.1 | — | 1.0 | — | 46.3 | 46.2 |
| 2-11 | 89.8 | Balance | 6.8 | 0.8 | 0.7 | — | — | — | 0.6 | 59.9 | 31.1 |
| 2-12 | 92.7 | Balance | 1.4 | 1.5 | 0.7 | 1.6 | — | 1.2 | — | 46.6 | 46.7 |
| 2-13 | 92.3 | Balance | 6.9 | 1.6 | — | 1.4 | 0.7 | 0.6 | 0.7 | 44.2 | 43.8 |
| 2-14 | 92.4 | Balance | 4.4 | 0.6 | 0.8 | — | 0.6 | — | — | 46.8 | 46.5 |
| 2-15 | 92.3 | Balance | 8.9 | 1.7 | 1.2 | 1.0 | — | 1.1 | 0.2 | 43.1 | 42.6 |

TABLE 10

| Type | | Width of Flank Wear (mm) | | | Type | | Width of Flank Wear (mm) | | |
|---|---|---|---|---|---|---|---|---|---|
| | | Cutting conditions 2-A | Cutting conditions 2-B | Cutting conditions 2-C | | | Cutting conditions 2-A | Cutting conditions 2-B | Cutting conditions 2-C |
| Cutting inserts of present invention | 2-1 | 0.09 | 0.20 | 0.20 | Conventional cutting inserts | 2-1 | 0.34 | 0.40 | 0.49 |
| | 2-2 | 0.10 | 0.17 | 0.21 | | 2-2 | 0.34 | 0.36 | 0.45 |
| | 2-3 | 0.11 | 0.16 | 0.21 | | 2-3 | 0.36 | 0.41 | 0.49 |
| | 2-4 | 0.11 | 0.16 | 0.21 | | 2-4 | 0.35 | 0.37 | 0.47 |
| | 2-5 | 0.10 | 0.17 | 0.19 | | 2-5 | 0.35 | 0.40 | 0.46 |
| | 2-6 | 0.09 | 0.16 | 0.21 | | 2-6 | 0.37 | 0.42 | 0.49 |
| | 2-7 | 0.09 | 0.18 | 0.22 | | 2-7 | 0.34 | 0.39 | 0.44 |
| | 2-8 | 0.11 | 0.20 | 0.19 | | 2-8 | 0.36 | 0.38 | 0.46 |
| | 2-9 | 0.13 | 0.16 | 0.20 | | 2-9 | 0.34 | 0.43 | 0.49 |
| | 2-10 | 0.11 | 0.19 | 0.20 | | 2-10 | 0.33 | 0.36 | 0.44 |
| | 2-11 | 0.10 | 0.18 | 0.22 | | 2-11 | 0.34 | 0.43 | 0.47 |
| | 2-12 | 0.11 | 0.17 | 0.21 | | 2-12 | 0.34 | 0.40 | 0.46 |
| | 2-13 | 0.09 | 0.18 | 0.20 | | 2-13 | 0.38 | 0.41 | 0.48 |
| | 2-14 | 0.09 | 0.19 | 0.22 | | 2-14 | 0.34 | 0.38 | 0.49 |
| | 2-15 | 0.12 | 0.17 | 0.18 | | 2-15 | 0.33 | 0.37 | 0.44 |

Based on the results shown in Tables 6 to 10, in all of the cutting inserts 2-1 to 2-15 of the present invention, the binding phase of the TiCN-based cermet making up these cutting inserts contained W at a high ratio of 40 to 60% as the ratio in the binding phase; thereby, the cutting inserts were provided with superior high-temperature hardness, as a result, the cutting inserts were determined to demonstrate superior wear resistance even during high-temperature cutting accompanying generation of high levels of heat. In contrast, in the conventional cutting inserts 2-1 to 2-15, the ratio of W contained in the binding phase was low at 1 to 10% as the ratio in the binding phase in all of these cutting inserts. As a result, the binding phase cannot be expected to demonstrate superior high-temperature hardness. Consequently, it is clear that progression of wear of the binding phase is accelerated particularly during high-speed cutting, thereby leading to a comparatively short service life.

As has been described above, a cutting insert of the present invention demonstrates superior wear resistance not only during cutting under ordinary conditions such as when cutting various types of steel and cast iron, but also during high-speed cutting accompanying the generation of high levels of heat. Consequently, this cutting insert is able to adequately accommodate conservation of power, conservation of energy and reduction of costs.

Example 3

The following provides a more detailed explanation of the cermet insert (to be simply referred to as a cutting insert) and the cutting tool of the third embodiment through an example thereof.

First, $TiC_{0.5}N_{0.5}$ powder having a mean particle diameter of 0.5 to 2 μm, $TiC_{0.3}N_{0.7}$ powder having a mean particle diameter of 0.5 to 2 μm, WC powder having a mean particle diameter of 1 to 2 μm, TaC powder having a mean particle diameter of 1 to 2 μm, NbC powder having a mean particle diameter of 1 to 2 μm, Co powder having a mean particle diameter of 2 to 3 μm, and Ni powder having a mean particle diameter of 2 to 3 μm were prepared. These raw material powders were blended in the blended compositions shown in Table 11 to prepare four types of mixed powders consisting of 3-A to 3-D.

TABLE 11

| Composition | Blended Composition (mass %) | | | | | | |
|---|---|---|---|---|---|---|---|
| | $TiC_{0.5}N_{0.5}$ | $TiC_{0.3}N_{0.7}$ | WC | TaC | NbC | Co | Ni |
| 3-A | 25 | 25 | 28 | — | 5 | 8 | 9 |
| 3-B | 25 | 25 | 28 | 10 | — | 6 | 6 |
| 3-C | 30 | 30 | 20 | — | 6 | 7 | 7 |
| 3-D | 35 | 20 | 25 | — | 6 | 7 | 7 |

Each of the mixed powders of 3-A to 3-D was respectively wet-mixed for 24 hours in alcohol with a ball mill and then dried.

The dried powders were pressed into compacts at a pressure of 98 MPa.

Figure 7:
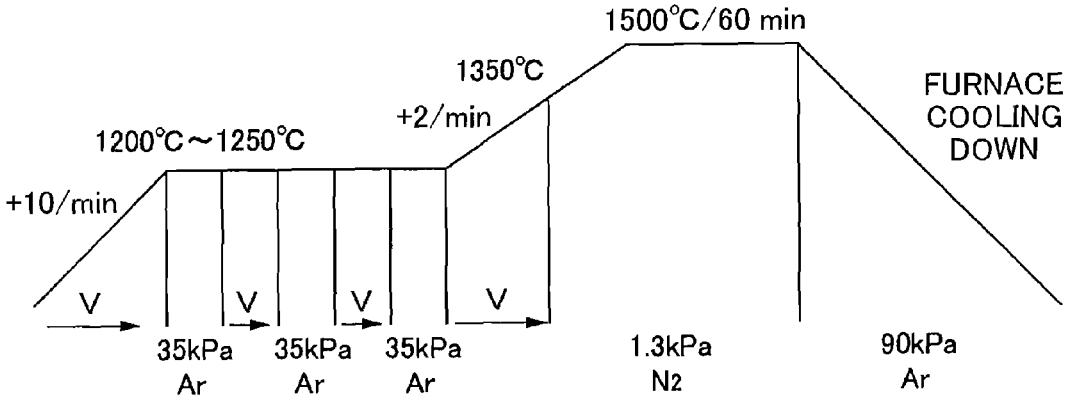
FIG. 7 is an explanatory drawing showing a production method of a cermet insert of examples.

Next, the compacts were sintered under the following conditions (a) to (e) as shown in FIG. 7.

(a) The temperature was raised from room temperature to 1200° C. at the rate of 10° C./min. in a vacuum atmosphere (V) at 10 Pa or less.

(b) After having raised the temperature to 1200° C. (intermediate temperature: a temperature of 1200 to 1250° C. can be adopted for the intermediate temperature), alternately changing atmosphere treatment was carried out by repeatedly alternating between holding in an Ar atmosphere for a short period of time which includes holding for 2 minutes in an Ar atmosphere at 35 kPa, and holding in a vacuum atmosphere for a short period of time which includes holding for 15 minutes in a vacuum atmosphere at 10 Pa or less.

(c) After the aforementioned alternately changing atmosphere treatment, the temperature was raised to 1350° C. at the rate of 2° C./min in a vacuum atmosphere at 10 Pa or less.

(d) The temperature was raised from 1350° C. to a predetermined sintering temperature (1500° C.) at the rate of 2° C./min, and then the temperature was held at the aforementioned sintering temperature for 60 minutes. Raising the temperature to the sintering temperature and holding at the sintering temperature were carried out in a nitrogen atmosphere at 1.3 kPa.

(e) Cooling of the furnace from the aforementioned sintering temperature was carried out in an Ar atmosphere at 90 kPa or less.

After sintering under conditions including the aforementioned steps (a) to (e), inserts 1 were produced in the shape of an ISO standard SNGN120408 tip by polishing.

Namely, inserts of sample nos. 3-1 to 3-4 corresponding to the four types of the mixed powders were respectively produced as shown in the following Table 12.

In addition, comparative example inserts (sample nos. 3-5 to 3-7) were respectively produced under substantially the same conditions with the exception of adopting different intermediate temperatures as indicated in the following Table 12.

TABLE 12

| | Sample No. | Composition | Intermediate Temperature (° C.) |
|---|---|---|---|
| Examples of Present Invention | 3-1 | 3-A | 1200 |
| | 3-2 | 3-B | 1200 |
| | 3-3 | 3-C | 1250 |
| | 3-4 | 3-D | 1250 |
| Comparative Examples | 3-5 | 3-B | 1300 |
| | 3-6 | 3-C | 1350 |
| | 3-7 | 3-D | 1350 |

The following provides an explanation of compositional analyses and cutting evaluations carried out on the inserts of sample nos. 3-1 to 3-4 of the present invention and the inserts of sample nos. 3-5 to 3-7 of the comparative examples produced in accordance with the production method described above.

(1) Compositional Analyses

Quantitative determination was carried out on the components (elements) contained in each of the inserts (sintered bodies) of sample nos. 3-1 to 3-4 of the present invention and sample nos. 3-5 to 3-7 of the comparative examples. The amounts of these components were also determined as compounds thereof. Those results are shown in Tables 13 and 14.

TABLE 13

| | Sample | | Insert (Sintered Body) Element Composition (mass %) | | | | | |
|---|---|---|---|---|---|---|---|---|
| | No. | Blend | Ti | W | Ta | Nb | Co | Ni |
| Examples of Present Invention | 3-1 | 3-A | 44 | 35 | — | 5 | 8 | 8 |
| | 3-2 | 3-B | 47 | 32 | 9 | — | 6 | 6 |
| | 3-3 | 3-C | 53 | 28 | — | 6 | 6 | 7 |
| | 3-4 | 3-D | 48 | 32 | — | 6 | 7 | 7 |
| Comparative Examples | 3-5 | 3-B | 47 | 30 | 11 | — | 6 | 6 |
| | 3-6 | 3-C | 56 | 26 | — | 5 | 6 | 7 |
| | 3-7 | 3-D | 52 | 30 | — | 5 | 6 | 7 |

TABLE 14

| | Sample | | Insert (Sintered Body) Element Composition Converted as Compounds (mass %) | | | | | |
|---|---|---|---|---|---|---|---|---|
| | No. | Blend | TiCN | WC | TaC | NbC | Co | Ni |
| Examples of Present Invention | 3-1 | 3-A | 49 | 32 | — | 5 | 7 | 7 |
| | 3-2 | 3-B | 52 | 30 | 8 | — | 5 | 5 |
| | 3-3 | 3-C | 58 | 25 | — | 6 | 5 | 6 |
| | 3-4 | 3-D | 53 | 29 | — | 6 | 6 | 6 |
| Comparative Examples | 3-5 | 3-B | 50 | 30 | 10 | — | 5 | 5 |
| | 3-6 | 3-C | 60 | 24 | — | 5 | 5 | 6 |
| | 3-7 | 3-D | 54 | 30 | — | 5 | 5 | 6 |

In addition, the compositions of the binding phases of the inserts were analyzed by STEM (scanning transmission electron microscopy) analysis and EDS. Those results are shown in the following Table 15.

TABLE 15

| | Sample | | Binding Phase Element Composition Converted as Compounds (mass %) | | | | | |
|---|---|---|---|---|---|---|---|---|
| | No. | Blend | Ti/Impurities | W | Ta | Nb | Co | Ni |
| Examples of Present Invention | 3-1 | 3-A | 1 | 53 | — | 1 | 22 | 23 |
| | 3-2 | 3-B | 1 | 49 | 1 | — | 24 | 25 |
| | 3-3 | 3-C | 1 | 44 | — | 1 | 27 | 27 |
| | 3-4 | 3-D | 1 | 48 | — | 1 | 25 | 25 |
| Comparative Examples | 3-5 | 3-B | 1 | 59 | 1 | — | 19 | 20 |
| | 3-6 | 3-C | 1 | 54 | — | 1 | 22 | 22 |
| | 3-7 | 3-D | 1 | 59 | — | 1 | 19 | 20 |

Moreover, W content was also determined. Those results are shown in the following Table 16.

Here, the amount of W in the binding phase based on the entire cermet (entire sintered body), the amount of W in the hard phase based on the entire cermet, and the amount of W in the binding phase based on the total amount of W can be respectively determined using the following equations (1) to (3). Furthermore, the amount of elementary W (mass %) rather than the amount of W converted as W compounds was used to calculate the amounts of W.

Amount of W in binding phase (mass %)=(W in binding phase composition)×(Co+Ni in sintered body composition)/(Co+Ni in binding phase composition) (1)

Amount of W in hard phase (mass %)=(Amount of W in sintered body)−(Amount of W in binding phase) (2)

Amount of W in binding phase based on total amount of W=(Amount of W in binding phase)/(Total amount of W) (3)

TABLE 16

| | | | W (mass %) | | Content ratio of W in binding phase/hard phase (%) Eq. (3) | |
|---|---|---|---|---|---|---|
| | Sample No. | Blend | Eq. (1) Amount of W in binding phase based on entire insert | Eq. (2) Amount of W in hard phase based on entire insert | Amount of W in binding phase based on total amout of W | Amount of W in hard phase based on total amount of W |
| Examples of Present Invention | 3-1 | 3-A | 19 | 16 | 54 | 46 |
| | 3-2 | 3-B | 12 | 20 | 38 | 62 |
| | 3-3 | 3-C | 11 | 17 | 38 | 62 |
| | 3-4 | 3-D | 13 | 19 | 42 | 58 |
| Comparative Examples | 3-5 | 3-B | 18 | 12 | 61 | 39 |
| | 3-6 | 3-C | 16 | 10 | 61 | 39 |
| | 3-7 | 3-D | 20 | 10 | 66 | 34 |

(2) Breakage Resistance Test

Each sample insert was bolted to the end of a steel shank tool holder (holder) with a fixture to obtain cutting tools.

A dry, intermittent high-speed cutting test of alloy steel was then carried out under the cutting conditions shown in the following Table 17 using these cutting tools. Furthermore, a breakage resistance test was carried out using 20 of the same types of inserts.

The cumulative breakage ratio after 700 impacts (ratio of the number of inserts in which breakage occurred after 700 times) was investigated. Those results are shown in the following Table 18.

(3) Wear Resistance Test

Each sample insert was bolted to the end of a steel shank tool holder (holder) with a fixture to obtain cutting tools.

A dry, intermittent high-speed cutting test of alloy steel was then carried out under the cutting conditions shown in the following Table 17 using these cutting tools.

The width of flank wear (amount of wear VB) after cutting for 4 minutes was measured. Those results are shown in the following Table 18.

TABLE 17

| Cutting Conditions | Units | Breakage Resistance Test Cumulative breakage ratio after 700 impacts | Wear Resistance Test Amount of wear $V_B$ after 4 minutes of cutting |
|---|---|---|---|
| Cutting speed | (m/min) | 200 | 300 |
| Feed rate (f) | (mm/rev) | 0.25 | 0.15 |
| Depth of cut | (mm) | 1.5 | 1.5 |
| Wet/Dry | | Wet | Wet |
| No. of impacts | (Times) | 700 | — |
| Cutting time | (min) | — | 4 |
| Tip shape | | SNGN120408 | SNGN120408 |
| Cut material | | SNCM439 (ϕ200 mm round bar: 4 slits at equal intervals in axial direction) | SNCM439 (ϕ200 mm round bar) |

TABLE 18

| | Sample No. | Composition | Intermediate Temperature (° C.) | Cutting Evaluation Cumulative breakage ratio (%) | Cutting Evaluation Amount of Wear $V_B$ (mm) |
|---|---|---|---|---|---|
| Examples of Present Invention | 3-1 | 3-A | 1200 | 25 | 0.11 |
| | 3-2 | 3-B | 1200 | 15 | 0.09 |
| | 3-3 | 3-C | 1250 | 20 | 0.10 |
| | 3-4 | 3-D | 1250 | 15 | 0.10 |
| Comparative Examples | 3-5 | 3-B | 1300 | 35 | 0.09 |
| | 3-6 | 3-C | 1350 | 40 | 0.10 |
| | 3-7 | 3-D | 1350 | 35 | 0.11 |

As is clear from Tables 11 to 18, in the inserts of the present invention, in particular, 40 to 65 mass % of the W contained in the insert are contained in the hard phase, and the balance of the W is contained in the binding phase. Consequently, the inserts of the present invention have the remarkable effect of being able to realize both high wear resistance and breakage resistance.

Furthermore, the present invention is not limited to the aforementioned examples, but rather can be carried out in various aspects thereof within a scope that does not deviate from the present invention.

INDUSTRIAL APPLICABILITY

Since the insert of the present invention including titanium carbonitride-based cermet demonstrates superior wear resistance during high-speed cutting accompanying generation of high levels of heat, it is used in various types of turning. In addition, since the cermet insert and the cutting tool of the present invention are also able to realize high breakage resistance together with being able to maintain a high level of wear resistance, they are used in various types of turning.

The invention claimed is:

1. A titanium carbonitride-based cermet insert containing a titanium carbonitride-based cermet having a microstructure comprising 75 to 90 area % of a hard phase and the balance as a binding phase, wherein the hard phase comprises:

(1) a first hard phase having a core-having structure in which a core portion includes a titanium carbonitride phase, and a peripheral portion includes a complex carbonitride phase having Ti, W, and one kind or two kinds of Ta and Nb (to be referred to as (Ti,W,Ta/Nb)CN);

(2) a second hard phase having a core-having structure in which both a core portion and a peripheral portion include (Ti,W,Ta/Nb)CN phases; and (3) a third hard phase having a single phase structure including a titanium carbonitride phase, and the binding phase contains a W—Co—Ni-based alloy having a composition comprising, as a ratio in the binding phase and by mass %, at least:

18 to 33 mass % of Co;

20 to 35 mass % of Ni;

5 mass % or less of Ti, and one kind or two kinds of Ta and Nb, the total amount thereof; and 40 to 60 mass % of W.

2. The titanium carbonitride-based cermet insert according to claim 1, wherein the titanium carbonitride-based cermet is a sintered body of a compact having a blended composition comprising, by mass %, at least:

20 to 30% of tungsten carbide;

5 to 10% of one kind or two kinds of tantalum carbide and niobium carbide;

5 to 10% of Co;

5 to 10% of Ni; and 50 to 60% of titanium carbonitride.

3. A titanium carbonitride-based cermet insert containing a titanium carbonitride-based cermet having a microstructure comprising 75 to 93 area % of a hard phase and the balance as a binding phase, wherein the hard phase comprises:

(1) a first hard phase having a core-having structure in which a core portion includes a titanium carbonitride phase, and a peripheral portion includes a complex carbonitride phase having Ti, W, one kind or two kinds of Ta and Nb, and one kind or two or more kinds of Zr, V and Mo (to be referred to as (Ti,W,Ta/Nb,Zr/V/Mo)CN);

(2) a second hard phase having a core-having structure in which both a core portion and a peripheral portion include (Ti,W,Ta/Nb,Zr/V/Mo)CN phases; and (3) a third hard phase having a single phase structure including a titanium carbonitride phase, and the binding phase contains a W—Co—Ni-based alloy having a composition comprising, as a ratio in the binding phase and by mass %, at least:

18 to 33 mass % of Co;

20 to 35 mass % of Ni;

Ti, one kind or two kinds of Ta and Nb, and one kind or two or more kinds of Zr, V and Mo, the total amount thereof is 5 mass % or less; and 40 to 60 mass % of W.

4. The titanium carbonitride-based cermet insert according to claim 3, wherein the titanium carbonitride-based cermet is a sintered body of a compact having a blended composition comprising, by mass %, at least:

20 to 30% of tungsten carbide;

5 to 10% of one kind or two kinds of tantalum carbide and niobium carbide;

1 to 5% of one kind or two kinds of zirconium carbide, vanadium carbide and molybdenum carbide;

5 to 10% of Co;

5 to 10% of Ni; and 50 to 60% of titanium carbonitride.

5. A cermet insert containing a titanium carbonitride-based cermet comprising a sintered body containing Ti, one kind or two kinds of Ta and Nb, and W, wherein a total of an amount of Ti converted as carbonitride, an amount of the one kind or two kinds of Ta and Nb converted as carbide, and an amount of W converted as carbide is 70 to 95 mass % as a ratio to the entire constitution that makes up the sintered body, an amount of W converted as carbide is 20 to 35 mass % as a ratio to the entire constitution, an amount of Co and Ni is 5 to 30 mass % as a ratio to the entire constitution, the cermet insert has a microstructure comprising: a hard phase containing at least a complex carbonitride including Ti, W, and one kind or two kinds of Ta and Nb (to be referred to as (Ti,W,Ta/Nb)CN); and a binding phase including, as main components thereof, W and one kind or two kinds of Co and Ni, and among the W contained in the entire constitution, 40 to 65 mass % is contained in the hard phase while the balance is contained in the binding phase.

6. The cermet insert according to claim 5, wherein the hard phase further contains titanium carbonitride.

7. The cermet insert according to claim 5, wherein an amount of Ti converted as carbonitride is 45 to 60 mass % as a ratio to the entire constitution, and an amount of one kind or two kinds of Ta and Nb converted as carbide is 5 to 10 mass % as a ratio to the entire constitution.

8. The cermet insert according to claim 5, wherein the hard phase comprises one kind or two kinds of:

(1) a first hard phase having a core-having structure in which a core portion includes titanium carbonitride phase and a peripheral portion includes a (Ti,W,Ta/Nb)CN phase; and (2) a second hard phase having a core-having structure in which both a core portion and a peripheral portion include (Ti,W,Ta/Nb)CN phases.

9. The cermet insert according to claim 6, wherein the hard phase further comprises:

(3) a third hard phase having a single phase structure including a titanium carbonitride phase.

10. The cermet insert according to claim 5, wherein Mo is further contained in one or both of the hard phase and the binding phase.

11. The cermet insert according to claim 5, wherein the binding phase contains W at 40 to 60 mass % as a ratio in the binding phase.

12. A cutting tool comprising a holder and the cermet insert according to claim 5 held and fixed by the holder.

* * * * *